US011131054B2

(12) United States Patent
Jeong et al.

(10) Patent No.: US 11,131,054 B2
(45) Date of Patent: Sep. 28, 2021

(54) LAUNDRY TREATING APPARATUS

(71) Applicant: LG Electronics Inc., Seoul (KR)

(72) Inventors: Jaeyong Jeong, Seoul (KR); Keunjoo Kim, Seoul (KR); Dongsoo Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 239 days.

(21) Appl. No.: 16/387,812

(22) Filed: Apr. 18, 2019

(65) Prior Publication Data

US 2019/0323160 A1 Oct. 24, 2019

(30) Foreign Application Priority Data

Apr. 18, 2018 (KR) ..... 10-2018-0045251
Apr. 27, 2018 (KR) ..... 10-2018-0049027
Apr. 27, 2018 (KR) ..... 10-2018-0049028

(51) Int. Cl.
*D06F 37/40* (2006.01)
*D06F 37/06* (2006.01)

(52) U.S. Cl.
CPC ..... *D06F 37/40* (2013.01); *D06F 37/06* (2013.01)

(58) Field of Classification Search
CPC ..... D06F 37/40; D06F 37/06
USPC ..... 68/23.7
See application file for complete search history.

(56) References Cited

U.S. PATENT DOCUMENTS 5,887,458 A 3/1999 Bae
6,332,343 B1 12/2001 Koketsu et al.
2005/0166643 A1* 8/2005 Cho ..... D06F 39/083 68/12.02
2012/0137738 A1 6/2012 Lee et al.

FOREIGN PATENT DOCUMENTS

KR 1020050113452 12/2005
KR 1020130117730 10/2013
KR 1020170016686 2/2017
WO WO2017092643 6/2017

OTHER PUBLICATIONS

Extended European Search Report in European Application No. 19169869.5, dated Sep. 3, 2019, 8 pages.

* cited by examiner

*Primary Examiner* — Tinsae B Ayalew
(74) *Attorney, Agent, or Firm* — Fish & Richardson P.C.

(57) ABSTRACT

A laundry treating apparatus includes: a tub; a drum; an agitator disposed in the drum; a stator; a rotor configured to rotate relative to the stator; a drum-rotating shaft coupled to the drum; an agitator-rotating shaft coupled to the rotor and the agitator; a first serration disposed at an end of the agitator-rotating shaft; a second serration disposed at an end of the drum-rotating shaft; a fixed body fixed between the tub and the rotor; a support body rotatably disposed within the fixed body; a body-driving system configured to move the support body relative to the fixed body; and a shaft-joint configured to reciprocate between a first point and a second point of the support body. The shaft-joint is configured to engage the first serration to the second serration at the first point, and decouple the first serration from the second serration at the second point.

20 Claims, 16 Drawing Sheets

LAUNDRY TREATING APPARATUS

CROSS-REFERENCE TO RELATED APPLICATIONS

This application claims a benefit under 35 U.S.C. § 119(a) of Korean Application No. 10-2018-0045251, filed on Apr. 18, 2018, Korean Application No. 10-2018-0049027, filed on Apr. 27, 2018, and Korean Application No. 10-2018-0049028, filed on Apr. 27, 2018, the entire disclosures of which are incorporated herein by reference for all purposes.

BACKGROUND

1. Field

The present disclosure relates to a laundry treating apparatus.

2. Description of Related Art

In general, a laundry treating apparatus collectively refers to a laundry washing apparatus, a laundry drying apparatus, and a laundry washing and drying apparatus.

A conventional laundry treating apparatus may be classified into a front loading type in which laundry is introduced into the apparatus through a laundry inlet disposed in a front face of the apparatus, and a top loading type in which laundry is input into an apparatus through a laundry inlet defined in a top of the apparatus.

In the conventional laundry treating apparatus, the larger a volume of a tub and a volume of a drum, the larger an amount of water may be accommodated, thereby improving a washing power. However, increasing the volumes of tub and drum increases a volume of the laundry treating apparatus. Increasing the washing power while minimizing the volumes of the tub and drum in the laundry treating apparatus is a very important factor in designing the laundry treating apparatus.

Such a laundry treating apparatus is gradually becoming larger in size in response to a recent user demand. That is, a size of a washing machine for domestic use is gradually becoming larger.

Generally, each household has one large laundry treating apparatus. Accordingly, when the laundry types are various, the laundry treating apparatus is used several times for each of the laundry type. For example, the laundry types may include adult laundry, underwear or baby clothes.

After a completion of washing of the adult laundry, the laundry treating apparatus is used again for baby laundry washing.

As a result, the washing time is long, and, also, energy as consumed is increased. In addition, a use of the large laundry treating apparatus for washing a small amount of laundry may not be desirable in terms of energy saving.

For this reason, there is a growing need for a small laundry treating apparatus that is much smaller than the conventional laundry treating apparatus. In recent years, in order to solve the problem, a small and auxiliary top-load type laundry treating apparatus arranged on top of a front load type laundry treating apparatus and operating individually has emerged.

The laundry treatment apparatus of the top-load type may be disposed on top of the front load type laundry treating apparatus or may be embodied as a drawer type and disposed below the front load type laundry treating apparatus, according to a user choice. Thus, a small amount of laundry may be washed using the small and auxiliary top-load type laundry treating apparatus. Further, space utilization can be improved, water or energy can be saved, and each of small amounts of laundry may be washed frequently.

In this connection, a conventional top-load type laundry treating apparatus may have a rotating drum to accommodate laundry therein and an agitator disposed on a bottom face of the drum to improve washing performance. Only one of the drum and agitator may rotate using either a clutch or the brake. Alternatively, the drum and the agitator rotate in the same direction or rotate in opposite directions, to apply a strong physical force to the laundry, thereby improving washing performance.

However, the top-load type laundry treating apparatus used as the auxiliary laundry treating apparatus is relatively small in height, so that a difference between volumes of water and laundry therein is small. Accordingly, when the clutch or the brake is installed, the height of the auxiliary laundry treating apparatus increases, thereby hindering accessibility of the user thereto or reducing a washing capacity.

In order to solve those problems, a buoyancy-based clutch has emerged in recent years, which vertically moves in accordance with a water level in the tub to control rotation of the agitator and the drum. The buoyancy-based clutch is not actively controlled, but is configured so that it may passively ascend and descend according to the water level and selectively control whether to rotate the drum. As a result, a configuration for separately controlling the clutch may be omitted, which leads to an advantage that a volume of the tub may be increased.

However, the laundry treating apparatus in which the buoyancy-based clutch is disposed has a problem in that separate sealing is required because water may flow from the tub into a motor with a rotary shaft.

Further, in the conventional laundry treating apparatus, there is a problem that, during the buoyancy-based clutch ascending and descending, air flows out due to collision of the clutch with the air collected near the rotary shaft for sealing.

Further, the buoyancy-based clutch must be coupled to the rotating shaft to prevent the clutch from tilting. Thus, there may be a problem that a center portion of the agitator coupled to a distal end of the rotary shaft may be excessively projected to secure a space for accommodating the buoyancy-based clutch.

Further, in order to dispose the buoyancy-based clutch, a plurality of components such as a hub disposed on a drum bottom face are additionally required. Further, a process of assembling the clutch and components may be complicated.

Furthermore, when separating the agitator from the drum, the buoyancy-based clutch may be removed from the agitator such that the buoyancy-based clutch may be broken.

Further, in the conventional laundry treating apparatus, when the water level is low in the tub, the water level is temporarily lowered due to biasing of the washing water. In this case, the buoyancy-based clutch is coupled to the drum bottom face, causing a malfunction.

SUMMARY

One purpose of the present disclosure is to provide a laundry treating apparatus which can increase a washing power while minimizing a volume of the laundry treating apparatus.

Further, another purpose of the present disclosure is to provide a laundry treating apparatus in which a drum for storing laundry and an agitator rotatably disposed in the drum are rotated using a single driving system.

Further, another purpose of the present disclosure is to provide a laundry treating apparatus in which a vertically-movable assembly is disposed to maintain an air gap to collect airs therein and thus to act as a seal.

Further, another purpose of the present disclosure is to provide a laundry treating apparatus in which the agitator and the vertically-movable assembly may be integrated with each other and thus prevented from being separated from each other.

In accordance with one aspect of the present disclosure, there is provided a laundry treating apparatus comprising: a tub having a space defined therein for containing water therein; a drum rotatably disposed within the tub, wherein the drum has a laundry storage space defined therein; an agitator rotatably disposed within the drum; a stator located outside the tub and generating a rotating magnetic field; a rotor located outside the tub and rotated by the rotating magnetic field; a drum-rotating shaft passing through the tub, wherein the drum-rotating shaft has one end fixed to the drum, and the other end as a free end located outside the tub; an agitator-rotating shaft passing through the drum-rotating shaft in a longitudinal direction thereof, wherein the agitator-rotating shaft has one end fixed to the rotor and the other end fixed to the agitator; a first serration formed on the rotor, wherein one end of the agitator-rotating shaft is engageable with the one end of the agitator-rotating shaft; a second serration formed on the free end of the drum-rotating shaft; a fixed body having a cylindrical shape and having an open top, wherein the fixed body is fixed to and between the tub and the rotor, wherein the fixed body has a first through-hole defined in a bottom face thereof through which the agitator-rotating shaft passes; a support body having a cylindrical shape and having an open top, wherein the support body is rotatable within the fixed body, wherein the support body has a second through-hole defined in a bottom face thereof through which the agitator-rotating shaft passes; a body-driving system configured to rotate the support body inside the fixed body; a conversion portion configured to convert a rotational motion of the support body into a linear reciprocating motion of the support body, wherein a direction of the linear reciprocating motion is parallel to a vertical direction of the fixed body; and a shaft-joint rotatably disposed within the support body, wherein the shaft-joint reciprocates between a first vertical and a second point based on a vertical level of the support body, wherein at the first point, the first serration and the second serration are maintained to be engaged with each other, wherein at the second point, the first serration and the second serration are maintained to be disengaged from each other.

In one implementation, the conversion portion includes: a first cam disposed on an inner circumferential face of the fixed body or an inner bottom face of the fixed body; a first inclined face formed on the first cam, wherein the first inclined face is inclined upwards from a bottom face of the fixed body toward a top face of the fixed body; a second cam disposed on an outer circumferential face of the support body; and a second inclined face formed on the second cam, wherein the second inclined face is engaged with the first inclined face and is inclined downwards from a top face of the support body to a bottom face of the support body.

In one implementation, the shaft-joint includes: a joint body; a third through-hole passing through the joint body; a serration-engaged portion partially defining the third through-hole, wherein each of the first and second serrations is engageable with the serration-engaged portion; and an annular protrusion formed along an outer circumferential face of the joint body, wherein the annular protrusion is supported on the support body, wherein the second through-hole has a larger diameter than an outer diameter of the joint body, and the second through-hole has a smaller diameter than an outer diameter of the annular protrusion.

In one implementation, the body-driving system includes: a motor fixed to the tub; a rotating plate rotated by the motor; an actuating bar having one end connected to the rotating plate and the other end connected to the support body; and a bar-rotating shaft extending between the rotating plate and the support body, wherein the bar-rotating shaft defines a rotational center of the actuating bar, wherein the bar-rotating shaft is configured to rotatably secure the actuating bar to the tub.

In one implementation, the apparatus further comprises: a fourth through-hole passing through a circumferential face of the fixed body; and a bar connector protruding away from a circumferential face of the support body, wherein the bar connector is exposed through the fourth through-hole to an outside of the fixed body, wherein the actuating bar is coupled to the bar connector.

In one implementation, the apparatus further comprises a spring having one end fixed to the tub and the other end contacting the shaft-joint, wherein the spring is configured to apply a force to press the shaft-joint toward the support body.

The laundry treating apparatus of claim 6, wherein the apparatus further comprises a spring receiving groove defined in one of a top face of the joint body and a top face of the annular protrusion, wherein a free end of the spring is received in the groove.

In one implementation, the drum-rotating shaft includes: a shaft through-hole passing through the drum-rotating shaft in a longitudinal direction; and a connecting gear formed on an inner face of the drum-rotating shaft defining the shaft through-hole; wherein the agitator-rotating shaft includes: a driving gear rotatably disposed within the shaft through-hole; at least two driven gears connecting the driving gear and the connecting gear; a gear housing rotatably disposed within the shaft through-hole, wherein the driven gears are rotatably coupled to the gear housing; a first shaft having one end fixed to the gear housing and the other end fixed to the agitator; and a second shaft having one end fixed to the driving gear and the other end passing through the first and second through-holes and fixed to the rotor.

In one implementation, the apparatus further comprises: a first laundry inlet passing through a top face of the tub; and a second laundry inlet passing through a top face of the drum, wherein the first and second laundry inlets communicate with each other, wherein each of the drum-rotating shaft and the agitator-rotating shaft extends to be orthogonal to the first laundry inlet.

In one implementation, the apparatus further comprises: a cabinet with an opening defined therein; a drawer configured to be withdrawn from the cabinet through the opening, wherein the tub is fixed to the drawer; a water supply for supplying water from a water source to the tub; and a water discharge system for discharging water stored in the tub out of the cabinet.

In accordance with another aspect of the present disclosure, there is provided a laundry treating apparatus comprising: a tub having a space defined therein for containing water therein; a drum rotatably disposed within the tub, wherein the drum has a laundry storage space defined therein; an agitator rotatably disposed within the drum; a stator located outside the tub and generating a rotating magnetic field; a rotor located outside the tub and rotated by the rotating magnetic field; a drum-rotating shaft passing through the tub, wherein the drum-rotating shaft has one end fixed to the drum, and the other end as a free end located outside the tub; an agitator-rotating shaft passing through the drum-rotating shaft in a longitudinal direction thereof, wherein the agitator-rotating shaft has one end fixed to the rotor and the other end fixed to the agitator; a first serration formed on the rotor; a second serration formed on the free end of the drum-rotating shaft; a shaft-joint configured to reciprocate between a first vertical and a second point, wherein at the first point, the first serration and the second serration are maintained to be engaged with each other, wherein at the second point, the first serration and the second serration are maintained to be disengaged from each other; a support body having a cylindrical shape and having an open top, wherein the support body is disposed between the tub and the rotor, wherein the shaft-joint is rotatably supported on the support body; a fixed body having a cylindrical shape and having an open top, wherein the support body is rotatably supported on the fixed body; a body-driving system configured to rotate the support body inside the fixed body; and a conversion portion configured to convert a rotational motion of the support body into a linear reciprocating motion of the support body, thereby to allow the shaft-joint to reciprocate between the first vertical and the second point.

According to the present disclosure, the air gap can be maintained to capture the air and to act as a sealing.

According to the present disclosure, the vertically-movable assembly is separated from a rotating shaft, such that a volume or height of the vertically-movable assembly itself may be reduced.

According to the present disclosure, a vertical level of the vertically-movable assembly may be lowered to a vertical level of the agitator to expand a washing volume.

According to the present disclosure, the agitator and vertically-movable assembly may be integrated with each other to prevent separation from each other According to the present disclosure, when water is supplied to the tub at a small quantity, malfunction may be suppressed.

According to the present disclosure, the washing power can be increased while minimizing the volume of the laundry treating apparatus.

According to the present disclosure, the agitator rotatably disposed within the drum and the drum where laundry is stored therein may be rotated by a single driving system.

DETAILED DESCRIPTIONS

Figure 1:
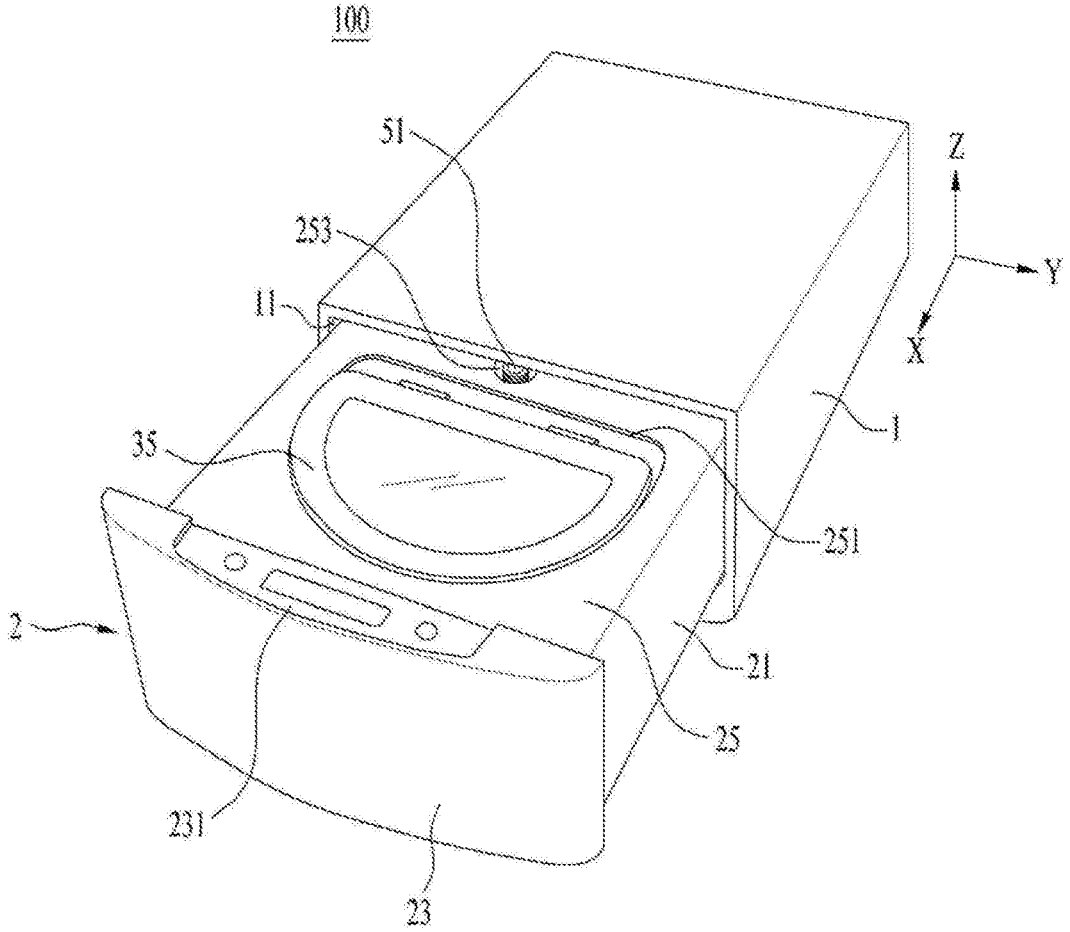
FIG. 1 and FIG. 2 show an example of a laundry treating apparatus according to the present disclosure.

For simplicity and clarity of illustration, elements in the figures. are not necessarily drawn to scale. The same reference numbers in different figures. denote the same or similar elements, and as such perform similar functionality. Also, descriptions and details of well-known steps and elements are omitted for simplicity of the description. Furthermore, in the following detailed description of the present disclosure, numerous specific details are set forth in order to provide a thorough understanding of the present disclosure. However, it will be understood that the present disclosure may be practiced without these specific details. In other instances, well-known methods, procedures, components, and circuits have not been described in detail so as not to unnecessarily obscure aspects of the present disclosure.

Examples of various embodiments are illustrated and described further below. It will be understood that the description herein is not intended to limit the claims to the specific embodiments described. On the contrary, it is intended to cover alternatives, modifications, and equivalents as may be included within the spirit and scope of the present disclosure as defined by the appended claims.

The terminology used herein is for the purpose of describing particular embodiments only and is not intended to be limiting of the present disclosure. As used herein, the singular forms "a" and "an" are intended to include the plural forms as well, unless the context clearly indicates otherwise. It will be further understood that the terms "comprises", "comprising", "includes", and "including" when used in this specification, specify the presence of the stated features, integers, operations, elements, and/or components, but do not preclude the presence or addition of one or more other features, integers, operations, elements, components, and/or portions thereof. As used herein, the term "and/or" includes any and all combinations of one or more of the associated listed items. Expression such as "at least one of" when preceding a list of elements may modify the entire list of elements and may not modify the individual elements of the list.

It will be understood that, although the terms "first", "second", "third", and so on may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure.

In addition, it will also be understood that when a first element or layer is referred to as being present "on" a second element or layer, the first element may be disposed directly on the second element or may be disposed indirectly on the second element with a third element or layer being disposed between the first and second elements or layers. It will be understood that when an element or layer is referred to as being "connected to", or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

Unless otherwise defined, all terms including technical and scientific terms used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 2:
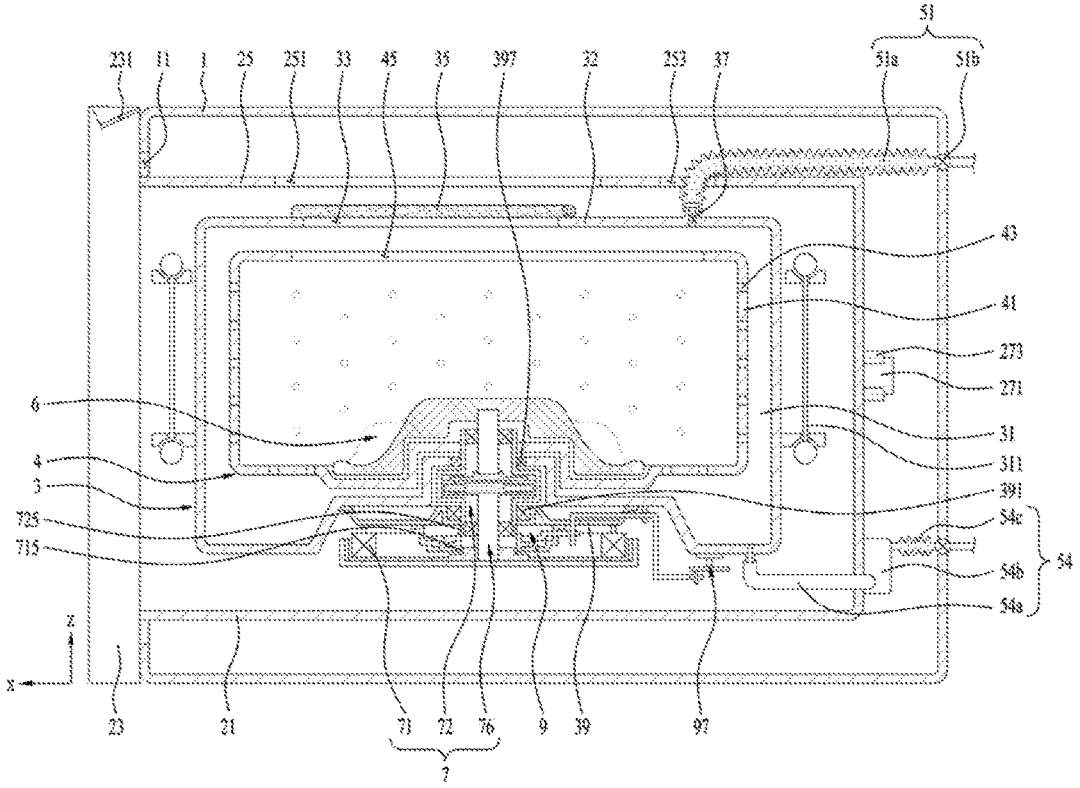

As shown in FIGS. 1 and 2, a laundry treating apparatus 100 according to the present disclosure laundry includes a cabinet 1, a drawer 2 configured to be drawable from the cabinet, a tub 3 disposed inside the drawer for storing water therein, and a drum 4 rotatably disposed inside the tub for storing laundry therein.

The cabinet 1 may refer to means for forming an appearance of the laundry treating apparatus or may simply define a space for receiving the drawer 2 (for example, a drawer accommodation space defined in an indoor wall). In either case, it is desirable that a front face of the cabinet 1 has an opening 11 defined therein through which the drawer 2 is inserted. The opening 11 may pass through the front face of the cabinet 1.

The drawer 2 includes a drawer body 21 inserted into the cabinet 1 through the opening 11, a drawer panel 23 fixed to a front face of the drawer body 21 to open and close the opening 11, and a drawer cover 25 defining a top of the drawer body 21. Because the drawer panel 23 is fixed to the front of the drawer body 21, the drawer panel 23 may also serve as a handle to allow a user to draw the drawer body 21 from the cabinet 1.

The drawer panel 23 may have a control panel 231 for inputting control commands relating to operations of the laundry treating apparatus 100 and for displaying messages relating to operation of the laundry treating apparatus to the user. The control panel 231 may include an input unit to which a control command is inputted, and a display unit to display a signal related to the operation of the laundry treating apparatus including the control commands. The display unit may be embodied as at least one of a device (e.g., LCD) for displaying characters or symbols. The control panel may further include a device (that is, speaker) for generating sound, and a device (for example, lamp) for emitting light.

The drawer body 21 may be inserted into the cabinet 1 through the opening 11. The drawer body may have any shape as long as it may define a space for receiving the tub 3. FIG. 1 shows an example of a hexahedral drawer body 21.

The drawer cover 25 has a first cover through-hole 251 and a second cover through-hole 253 which communicate the inside of the drawer body 21 with the outside. The first cover through-hole 251 may be arranged for entry and exit of laundry. The second cover through-hole 253 may be arranged to supply water necessary for washing the laundry. They will be described in detail later.

As shown in FIG. 2, according to the present disclosure, a slider may be arranged to provide a movement path of the drawer body 21. The slider may include a slider body 271 disposed on one of the cabinet 1 and drawer body 21 and a slider housing 273 disposed on the other of the cabinet and drawer body to provide a path of movement of the slider body.

The tub 3 includes a tub body 31, which is located inside the drawer body 21 and stores water, and a tub cover 32, which defines a top of the tub body 31. The tub body 31 may be formed in a cylindrical shape with its top face opened.

The tub body 31 may be formed in a cylindrical shape with an empty interior and may be fixed to the drawer body 21 via a tub support 311. The tub support 311 may have a first support disposed on the drawer body 21, a second support disposed on the tub body 31, and a connection bar for connecting the first support and the second support.

The tub cover 32 may include a laundry inlet 33 for communicating the inside of the tub body 31 with the outside of the tub body 31, and a water supply hole 37 for introducing water into the tub body 31.

The laundry inlet 33 should be located below the first cover through-hole 251 defined in the drawer cover. The water supply hole 37 may also be disposed below the second cover through-hole 253.

The laundry inlet 33 may refer to means for supplying laundry to the inside of the tub body 31 or for taking the laundry inside the tub body 31 outside the tub body 31. The laundry inlet 33 is opened and closed by a door 35 which is rotatably disposed on either the drawer cover 25 or the tub cover 32. FIG. 2 shows an example in which the door 35 is rotatably coupled to the tub cover 32 via a hinge.

The present laundry treating apparatus 100 supplies water to the tub 3 through a water supply. The water stored in the tub 3 is discharged to the outside of the cabinet 1 through a water discharge system.

The water supply may have a water supply pipe 51 for connecting a water supply hole 37 disposed in the tub cover and a water supply source, and a valve 513 for opening or closing the water supply pipe 51 according to a control signal from a controller.

The water supply pipe 51 is connected to the water supply hole 37 through the second cover through-hole 253 defined in the drawer cover 25. In order to prevent the water supply pipe 51 from being separated from the water supply hole 37 during the vibration of the tub 3, the water supply pipe 51 may be embodied at least partially as a corrugated pipe.

The water discharge system includes a pump **54*b* fixed to the drawer body 21, a first water discharge pipe 54*a* for guiding the water inside the tub body 31 to the pump 543, and a second water discharge pipe 54*c* for guiding the water discharged from the pump 54*b* to the outside of the cabinet 1. In this case, the first water discharge pipe 54*a* and the second water discharge pipe 54*c*** may be embodied as corrugated pipes.

The drum 4 disposed inside the tub 3 may have a cylindrical drum body 41 with a further laundry inlet 45 disposed in a top thereof. The further laundry inlet 45 is located below the laundry inlet 33, so that laundry supplied through the laundry inlet 33 will be fed to the drum body 41 through the further laundry inlet 45. A plurality of through-holes 43 for communicating the inside of the drum body 41 with the inner space of the tub body 31 are defined in a bottom face and a circumferential face of the drum body 41.

In accordance with the present disclosure, the laundry treating apparatus 100 includes an agitator 6 rotatably disposed within the drum body 41 to form a stream of water inside the drum body. The agitator 6 may be formed in any shape as long as the agitator can rotate inside the drum body 41. FIG. 2 shows an example in which the agitator 6 has a hub 61 connected to an agitator-rotating shaft 76, which will be described later, and a plurality of arms 63 fixed to the hub. The plurality of arms 63 may be arranged radially from a circumferential face of the hub 61 toward the circumferential face of the drum body 41.

The drum body 41 and agitator 6 rotate by a driving system 7 and a power transmission 9.

The driving system 7 includes a motor 71 for generating a torque, a drum-rotating shaft 72 passing through the tub 3 for rotating the drum body 41, and an agitator-rotating shaft 76 passing through the drum-rotating shaft for transmitting a driving force from the motor to the agitator 6.

In this case, the power transmission 9 may act as means for transmitting the rotating force provided from the motor 71 to the drum-rotating shaft 72.

Figure 3:
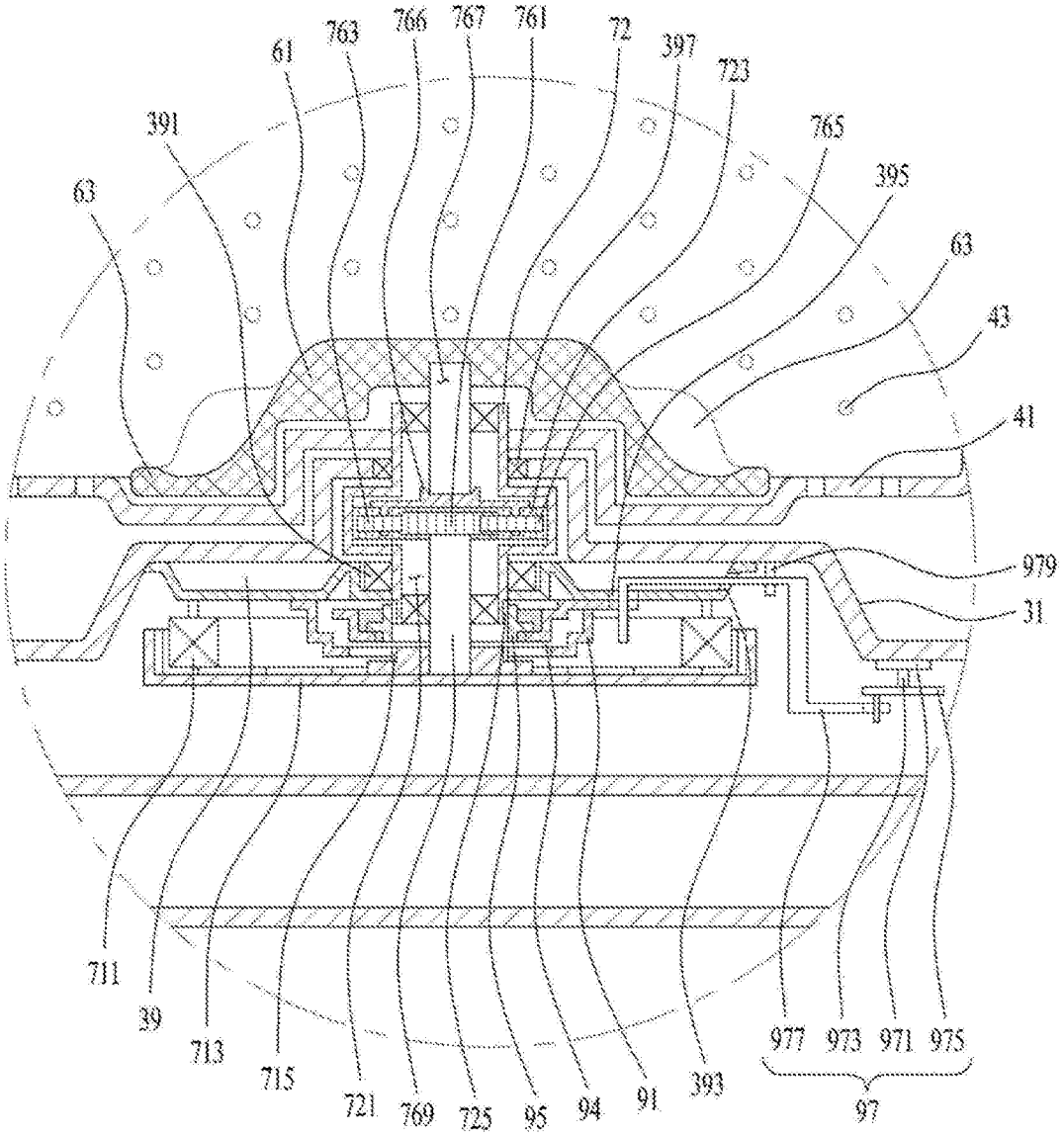
FIG. 3 shows an example of a driving system in accordance the present disclosure.

Referring to FIG. 3, the motor 71 includes a stator 711 fixed to the outside of the tub body 31 to generate a rotating field, and a rotor 713 disposed outside the tub body 31 and rotated by the rotating field.

The drum-rotating shaft 72 may be embodied as a hollow shaft passing through the bottom face of the tub body 31.That is, the drum-rotating shaft 72 is fixed at one end to the bottom face of the drum body 41, while the other end of the shaft 72 is exposed to the outside of the tub body 31. A shaft through-hole 721 may penetrate the shaft 72.

The drum-rotating shaft 72 may be rotatably secured to a bottom face of the tub body 31 via a first bearing 391 and a second bearing 397. A bearing housing 39 is disposed on the bottom face of the tub body 31. One of the first bearing 391 and the second bearing 397 may be fixed to the tub 3 via the bearing housing 39. In FIG. 3, the first bearing 391 is fixed to the tub body 31 via the bearing housing 39, and the second bearing 397 is integrally formed to the bottom face of the tub body 31. This is merely an example.

In the shaft through-hole 721, a connecting gear 723 is formed on the shaft 72. The connecting bar is disposed along the inner circumferential face of the drum-rotating shaft 72.

The agitator-rotating shaft 76 includes a driving gear 761 rotatably disposed within the shaft through-hole 721, at least two driven gears 763 and 765 connecting the driving gear 761 and the connecting gear 723, a gear housing 766 rotatably disposed within the shaft through-hole 721 to define a rotating shaft for the driven gears 763 and 765, a first shaft 767 fixed at one end to the gear housing 766 and at the other end to the hub 61 of the agitator, and a second shaft 769 having one end fixed to the driving gear 761 and the other end fixed to the rotor 713.

The driven gears includes a first driven gear 763 and a second driven gear 765 spaced from each other by a 180 degrees angular spacing. Alternatively, the driven gears may include the first driven gear 763, the second driven gear 965, and a third driven gear (not shown) spaced from each other by a 120 degrees angular spacing.

When the laundry treating apparatus in accordance with the present disclosure is embodied as a top-loading type washing machine, the drum-rotating shaft 72 and the agitator-rotating shaft 76 may be disposed orthogonally to the laundry inlet 33 defined in the tub cover 32. That is, the drum-rotating shaft 72, and the first shaft 767 and the second shaft 769 constituting the agitator-rotating shaft may be arranged to be orthogonal to the laundry inlet 33.

The fact that the drum-rotating shaft, first shaft and second shaft are orthogonal to the laundry inlet means that an angle between the drum-rotating shaft 72 and the laundry inlet 33, an angle between the first shaft 767 and the laundry inlet 33, and an angle between the second shaft 769 and the laundry inlet 33 is substantially 90 degrees within a tolerance range resulting from assembly thereof.

In the driving system 7 having the above-described structure, when the stator 711 is supplied with current and a rotating magnetic field is generated, the rotor 713 rotates. As a result, the second shaft 769 rotates degrees. During the rotation of the second shaft 769, the driving gear 761 and driven gears 763 and 765 rotate. The driven gears rotate to rotate the gear housing 766.

When the gear housing 766 rotates, the first shaft 767 fixed to the gear housing rotates. Thus, the agitator 6 will rotate in the same direction as the rotor when the rotor 713 rotates.

When the rotation of the rotor 713 causes the driving gear 761 and the driven gears 763 and 765 to rotate, the connecting gear 723 may receive a repulsive force provided from the driven gears 763 and 765. Thus, during rotation of the rotor 713, the drum-rotating shaft 72 will rotate in a direction opposite to the direction of rotation of the rotor 713.

The power transmission 9 refers to means for connecting a free end of the drum-rotating shaft 72 (one end of the drum-rotating shaft exposed to the outside of the tub body) to the rotor 713. When the drum-rotating shaft 72 is connected to the rotor 713 via the power transmission 9, the drum body 41 and the agitator 6 rotate in the same direction as the rotor 713.

Without the power transmission 9, the drum body 41 should always rotate in the opposite direction to the agitator 6. In such a situation, a spinning operation of removing water from the laundry cannot proceed. Thus, the power transmission 9 may refer to means for connecting the drum-rotating shaft 72 to the rotor 713 so that the drum body 41 and the agitator 6 can rotate in the same direction.

Figure 4:
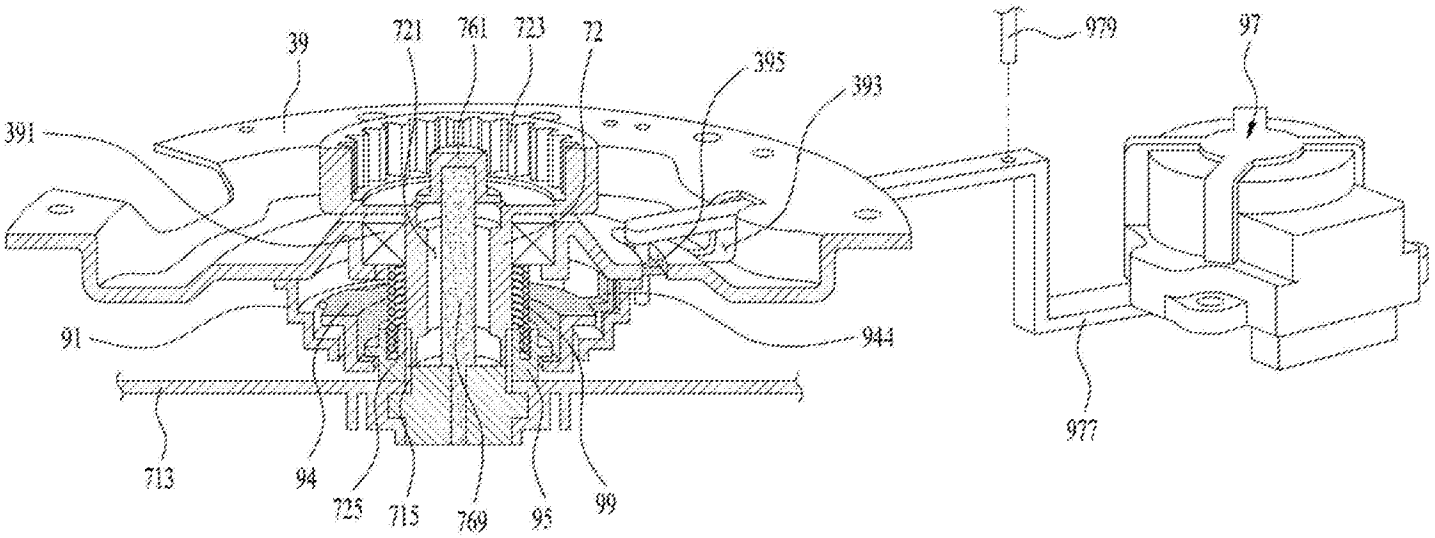
FIG. 4, FIG. 5, and FIG. 6 show an example of a power transmission in accordance with the present disclosure.

As shown in FIG. 4, the power transmission 9 includes: a shaft-joint 95 for connecting or disconnecting a first serration 715 disposed on the rotor 713 and a second serration 725 disposed on the free end of the drum-rotating shaft 72 to each other; a support body 94 for rotatably supporting the shaft-joint; a fixed body 91 for rotatably supporting the support body 94 and fixed to a bottom face of the tub body 31, wherein the fixed body 91 is embodied as a hollow cylinder having an open top; a body-driving system 97 that rotates the support body 94 within the fixed body 91; and a conversion portion 98. The conversion portion 98 converts the rotational motion of the support body 94 into a linear reciprocating motion of the support body 94, thereby causing the shaft-joint 95 to reciprocate between the two serrations 715 and 725.

The first serration 715 (a rotor gear) is fixed to the rotor 713 and surrounds the second shaft 769. The second serration 725 (a rotating shaft gear) is disposed on a circumferential ace of the drum-rotating shaft 72. The first serration 715 and the second serration 725 may have the same diameter.

Figure 5:
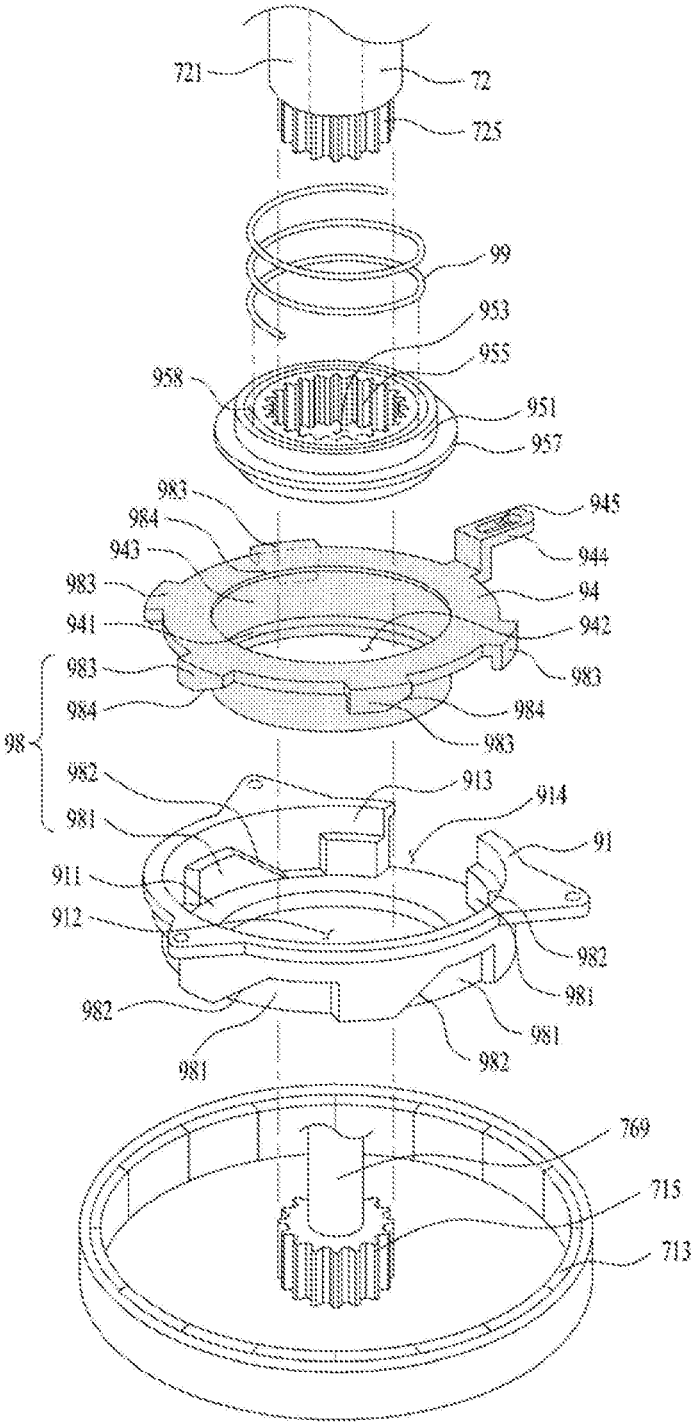

As shown in FIG. 5, the fixed body 91 includes a bottom face 911 and a circumference face 913 formed along an edge of the bottom face 911. A fixed body through-hole 912 is defined in the bottom face 911. A circumferential face through-hole 914 may be defined in the circumferential face 913. The fixed body 91 having the above-described structure may be fixed to the tub via the bearing housing 37 fixed to the bottom face of the tub body.

The fixed body through-hole 912 refers to means for communicating the inside of the fixed body 91 with the outside. The support body 94 and the shaft-joint 95 are movable through the fixed body through-hole 912 from the inside to the outside of the fixed body 91, or are movable through the fixed body through-hole 912 from the outside to the inside thereof.

The support body 94, which is formed in a cylindrically-shape and has an open top face, includes a bottom face 941 and a circumferential face 943. The bottom face 941 has a support body through-hole 942 defined therein communicating with the fixed body through-hole 912 and rotatably receiving the shaft-joint 95. The circumferential face 943 has a bar connector 944 to which the body-driving system 97 is connected.

Figure 6:
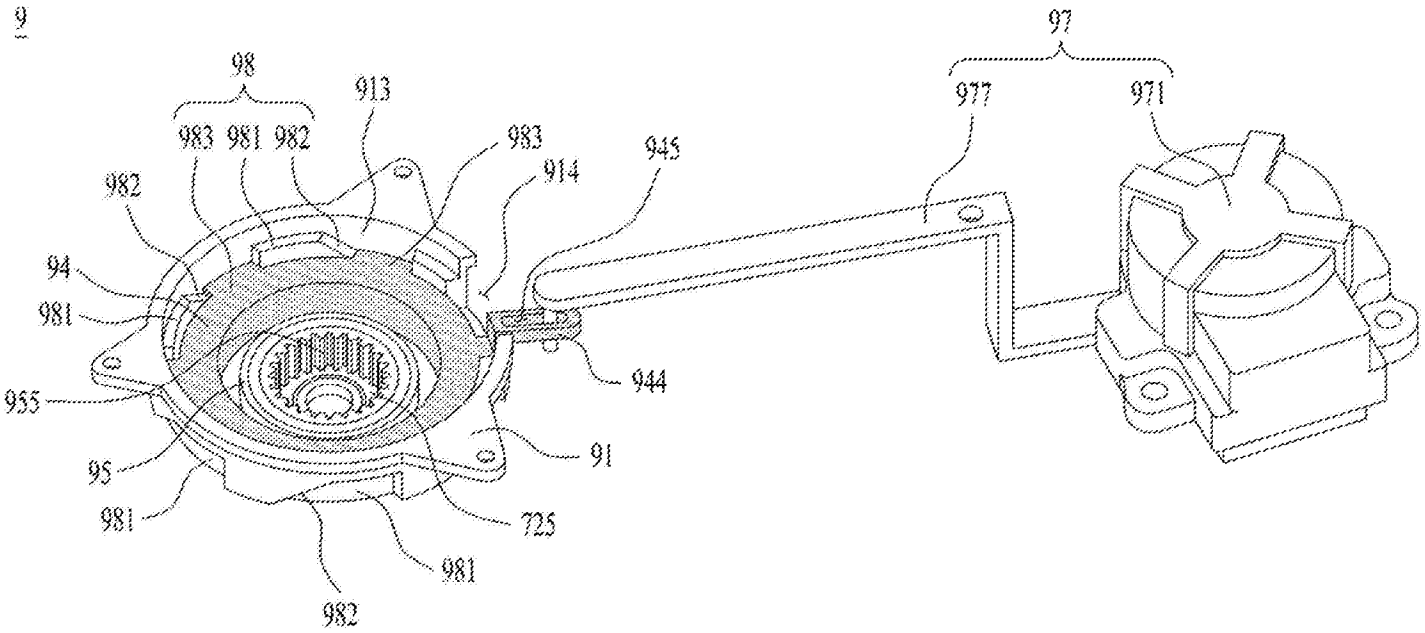

As shown in FIG. 6, the bar connector 944 is exposed to the outside of the fixed body 91 through a circumferential face through-hole 914 defined in the circumferential face 913. A width of the circumferential face through-hole 914 is set to be larger than a width of the bar connector 944 so that the bar connector 944 may move through the circumferential face through-hole 914.

As shown in FIG. 5, the shaft-joint 95 may include a joint body 951 formed in a bar shape, a joint body through-hole 953 defined in the joint body, a serration-engaged portion 955 defining the joint body through-hole, wherein the first serration 715 to the second serration 725 are engaged with the serration-engaged portion 955, and a joint body support 957 disposed along an outer circumferential face of the joint body 951.

An outer diameter of the joint body 951 is set to be smaller than a diameter of the support body through-hole 942. A diameter of the joint body support 957 is set to be larger than a diameter of the support body through-hole 942. Thus, the joint body 951 extends through the support body through-hole 942 and is rotatably supported on the support body 94 while the joint body support 957 is supported on the support body 94.

The serration-engaged portion 955 has an upper portion engaged with the first serration 715 and has a lower portion engaged with the second serration 725. When the first serration 715 and the second serration 725 have the same diameter, the serration-engaged portion 955 may have a single diameter. However, when the first serration 715 and the second serration 725 have different diameters, diameters of the upper and lower portions of the serration-engaged portion 955 should be set differently.

The power transmission 9 may include restoring means 99 that provides a restoring-force to the shaft-joint 95. The restoring means 99 may be embodied as a spring having one end fixed to the bottom face of the tub body 31, and the other end contacting a top of the shaft-joint 95. In this case, the spring is preferably configured to urge the joint body 951 toward the support body 94. It is preferable that a spring receiving recess 958 is defined in either a top face of the joint body 951 or a top face of the joint body support 957 to provide a space for receiving a free end of the spring.

The body-driving system 97 allows the support body 94 to rotate within the fixed body 91. Referring to FIG. 3, the body-driving system 97 may include a motor 971 for rotating a rotating shaft 973, a rotating plate 975 fixed to the rotating shaft, an actuating bar 977 having one end connected to the rotating plate and the other end connected to the bar connector 944 of the support body, and a bar-rotating shaft 979 disposed between the rotating plate 975 and the bar connector 944 to define a rotational center of the actuating bar 977.

The bottom face of the tub body 31 has a recess recessed toward the inside of the tub body. The bearing housing 39 or the stator 711 may be located in the recess (thereby minimizing the volume of the tub). In this case, the motor 971 may be fixed to a portion of the bottom face of the tub body 31 out of the recess. The actuating bar 977 has a first bar extending in a parallel manner to the bottom face of the tub body 31 and connected to the rotating plate 975, a second bar connected to the bar connector 944, and a connecting bar for connecting the first bar and the second bar. The bar-rotating shaft 979 may be disposed in the recess and rotatably coupled to the actuating bar 977.

As the rotating plate 975 is rotated by the rotating shaft 973, one end of the actuating bar 977 (one end of the actuating bar coupled to the connector) will move along an arc locus around the bar-rotating shaft 979. As shown in FIG. 6, the bar connector 944 may further include a slit 945 into which one end of the actuating bar 977 is inserted.

In one example, the bearing housing 39 may have a housing through-hole through which an actuating bar extends, in order to prevent interference between the bearing housing 39 and the actuating bar 977. FIG. 4 shows an example in which a first housing through-hole 393 and a second housing through-hole 395 through which the actuating bar 977 extends are defined in the bearing housing 39.

A conversion portion 98 in the power transmission 9 refers to a means for converting the rotational motion of the support body 94 into a linear reciprocating motion of the support body 94. Thus, the conversion portion 98 causes the shaft-joint 95 to reciprocate between a first point and a second point. At the first point of the joint 95, the first serration 715 and the second serration 725 remain connected to each other (see FIG. 2). At the second point of the joint 95, the first serration 715 and the second serration 725 remain separated from each other (see FIG. 3).

As shown in FIG. 5, the conversion portion 98 may include a first cam 981 disposed on the fixed body, and a second cam 983 disposed on the support body 94 to contact the first cam 981.

The first cam 981 is disposed along the circumferential face 913 of the fixed body. The second cam 983 is disposed on the circumferential face 943 of the support body so that the second cam 983 is engaged with the first cam 981. Alternatively, the first cam 981 may be disposed on the bottom face 911 of the fixed body while the second cam 983 may be disposed on the bottom face 941 of the support body.

The first cam 981 has a first inclined face 982 which is inclined upward from bottom face 911 of the fixed body toward the open top of the fixed body 91. The second cam 983 has a second inclined face 984 downwardly inclined from the open top face of the support body toward the bottom face 941 of the support body.

As shown in FIG. 6, the second inclined face 984 is engaged with the first inclined face 982. Accordingly, when the support body 94 rotates in the counterclockwise direction, the support body 94 moves in a direction to be drawn out from the fixed body 91. When the support body 94 rotates clockwise, the support body 94 moves in a direction to be inserted into the fixed body 91.

Hereinafter, an operation of the power transmission 9 having the above-described structure will be described.

As shown in FIG. 2, when the shaft-joint 95 connects the first serration 715 to the second serration 725 (when the shaft-joint is positioned at the first point), the rotating plate 973 is rotated counterclockwise by the motor 971 of the body-driving system. Thus, the actuating bar 977 will rotate the support body 94 counterclockwise.

Figure 7A:
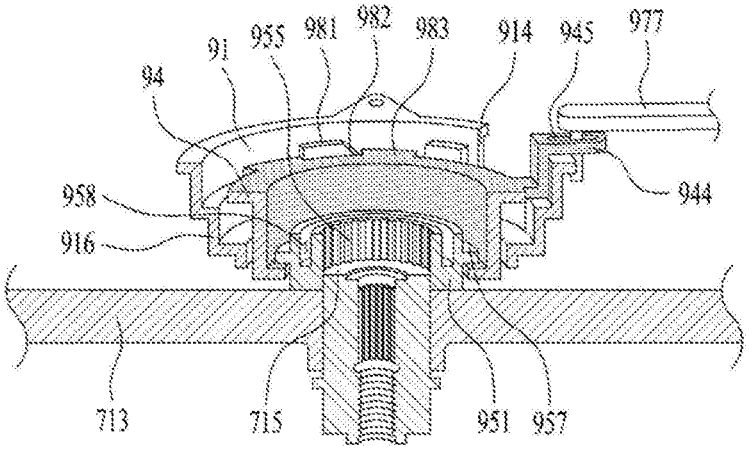
FIGS. 7A and 7B show an operation of the power transmission.
Figure 7B:
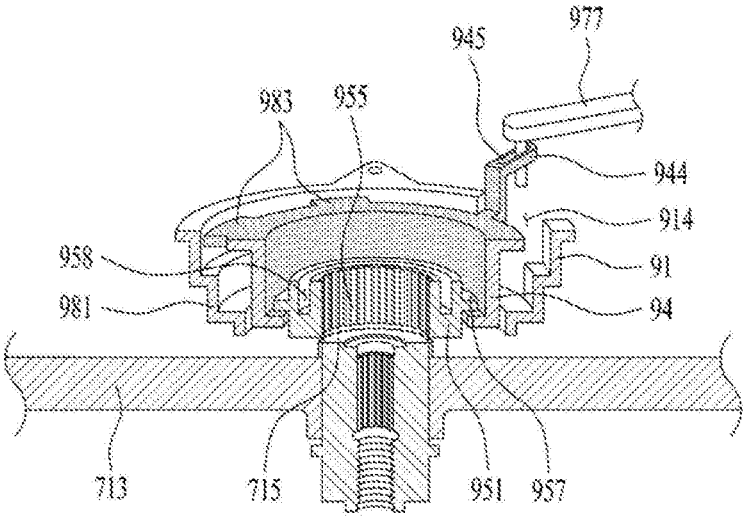

As shown in FIGS. 7A and 7B, when the support body 94 rotates counterclockwise, the first cam 981 and the second cam 983 may allow the support body 94 to move in a direction to be drawn out from the fixed body 91. That is, the support body moves toward the bearing housing disposed on the bottom face of the tub body.

When the support body 94 moves in the direction to be drawn out from the fixed body 91, the shaft-joint 95 moves together with the support body 94 toward the bearing housing 39. In this process, the shaft-joint 95 is separated from the first serration 715 disposed on the rotor 713. The restoring means 99 becomes compressed. In other words, the shaft-joint is located at the second point (FIG. 3).

Otherwise, when the rotating plate 973 rotates clockwise, the actuating bar 977 will rotate the support body 94 clockwise. In this case, the support body 94 will move in a direction to be inserted into the fixed body 91 and thus move the shaft-joint 95 to the first point.

When the motor 71 of the driving system works while the shaft-joint 95 is positioned at the first point as shown in FIG. 2, the laundry treating apparatus will rotate the drum body 41 and the agitator 6 in the same direction. However, when the motor 71 is actuated while the shaft-joint 95 is positioned at the second point as shown in FIG. 3, the drum body 41 and agitator 6 will rotate in different directions.

According to the present disclosure, the drum body 41 and the agitator 6 may rotate using the single driving system 7. Thus, a structure and a volume of the laundry treating apparatus may be minimized compared to a case where a driving system for rotating the drum body and a driving system for rotating the agitator are disposed separately.

Further, according to the present disclosure, the agitator 6 generates a stream of water inside the drum body 41. Thus, the water not only rubs laundry, but also blows the laundry directly. This may realize a laundry treating apparatus capable of maximizing the washing power while minimizing the volume thereof.

The abovementioned present disclosure is based on the case where the agitator-rotating shaft 76 includes the driving gear 761, the driven gear 763 and 765, the gear housing 766, the first shaft 767 and the second shaft 769. However, the present disclosure is not limited thereto. The agitator-rotating shaft 76 may be embodied as a single shaft connecting the rotor 713 and the hub 61 of the agitator. That is, although not shown in the drawing, the agitator-rotating shaft 76 may be inserted into the shaft through-hole 721 of the drum-rotating shaft, such that one end of the shaft 76 may be fixed to the hub 61, and the other end thereof may be fixed to the rotor 713.

Figure 8:
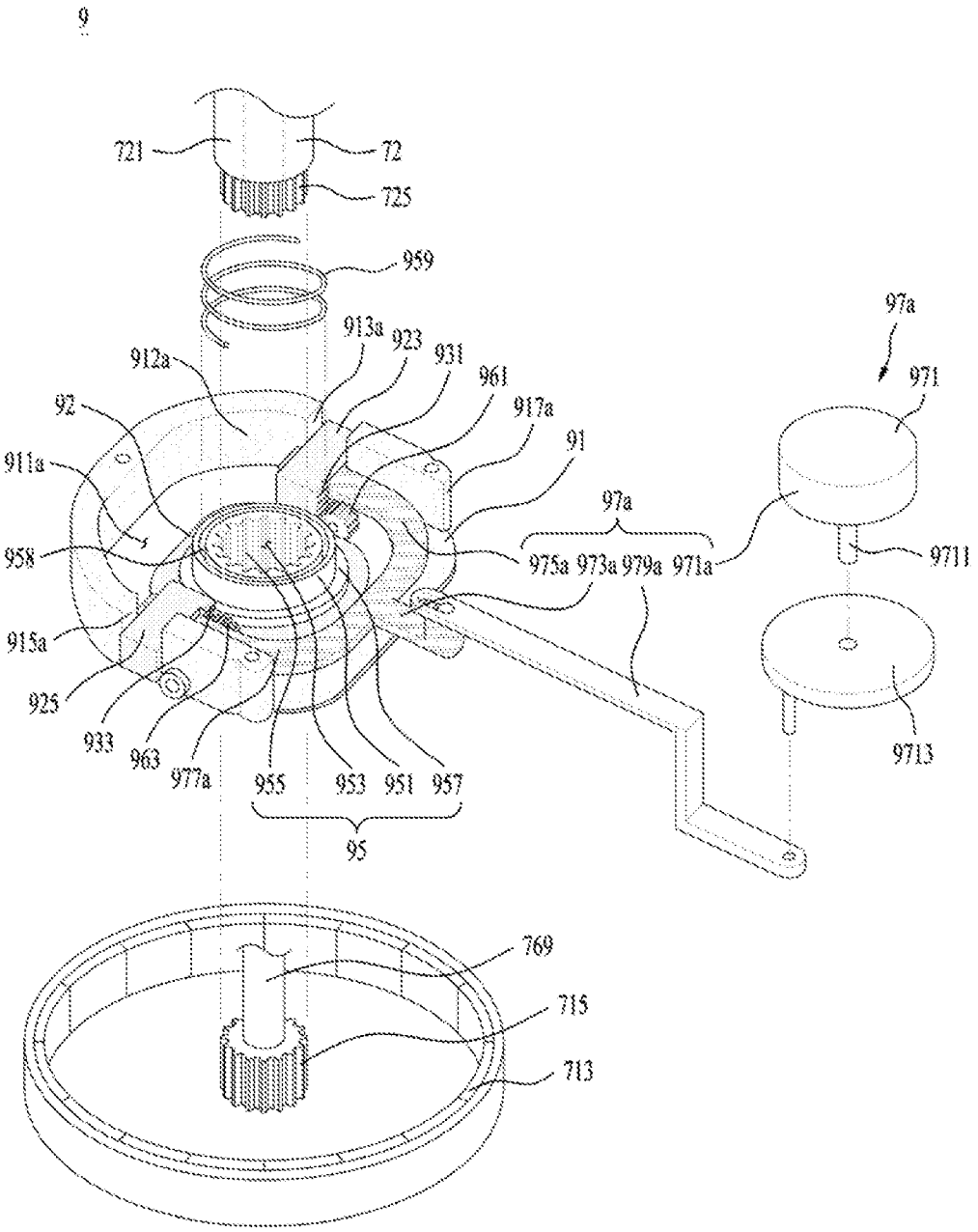
FIGS. 8 and 9 illustrate a power transmission in accordance with another embodiment of the present disclosure.
Figure 9:
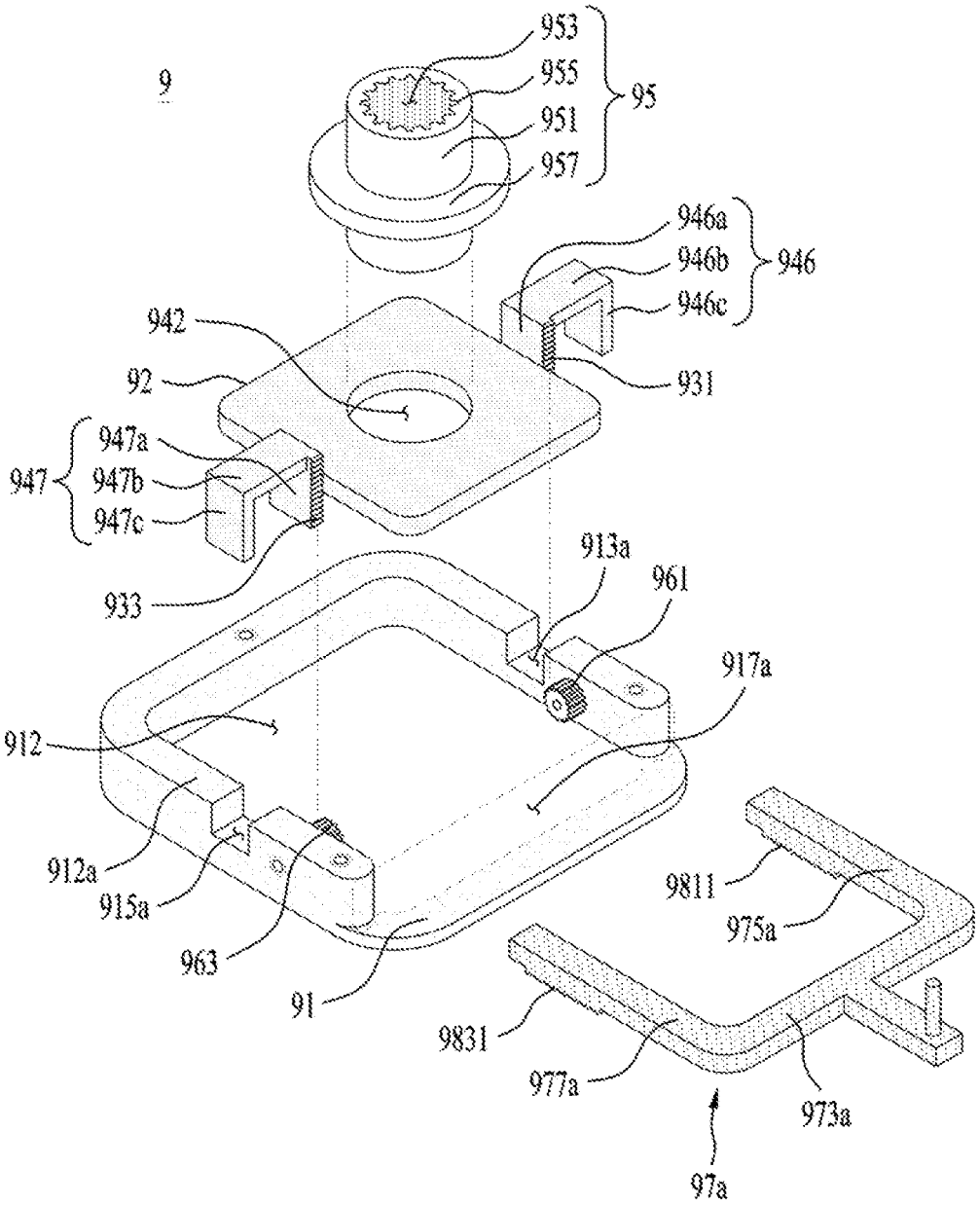

FIG. 8 and FIG. 9 illustrate a power transmission in accordance with another embodiment of the present disclosure.

Referring to FIG. 8, a power transmission 9 includes a shaft-joint 94 for connecting or disconnecting a first serration 715 disposed on the rotor 713 and a second serration 725 disposed on the free end of the drum-rotating shaft 72, a support body 94 for rotatably supporting the shaft-joint, and a support body moving mechanism that controls the position of the shaft-joint 95 by controlling the position of the support body 94.

The first serration 715 (a rotor gear) is fixed to the rotor 713 and surrounds the second shaft 769. The second serration 725 (a rotating shaft gear) is disposed on a circumferential ace of the drum-rotating shaft 72. The first serration 715 and the second serration 725 may have the same diameter.

The shaft-joint 95 may be configured to reciprocate between a first point and a second point. At the first point of the joint 95, the first serration 715 and the second serration 725 remain connected to each other (see FIG. 2). At the second point of the joint 95, the first serration 715 and the second serration 725 remain separated from each other (see FIG. 3).

As shown in FIG. 9, the shaft-joint 95 may include a joint body 951 formed in a bar shape, a joint body through-hole 953 defined in the joint body, a serration-engaged portion 955 defining the joint body through-hole, wherein the first serration 715 to the second serration 725 are engaged with the serration-engaged portion 955, and a joint body support 957 disposed along an outer circumferential face of the joint body 951.

The serration-engaged portion 955 has an upper portion engaged with the first serration 715 and has a lower portion engaged with the second serration 725. When the first serration 715 and the second serration 725 have the same diameter, the serration-engaged portion 955 may have a single diameter. However, when the first serration 715 and the second serration 725 have different diameters, diameters of the upper and lower portions of the serration-engaged portion 955 should be set differently.

As shown in FIG. 8, the shaft-joint 95 may have restoring means 959 that provides a restoring-force to the joint body 951. The restoring means 959 may be embodied as a spring one end fixed to the bottom face of the tub body 31, and the other end contacting a top of the joint body 951. In this case, the spring is preferably configured to urge the joint body 951 toward the support body 94. Preferably, one of a top face of the joint body 951 and a top face of the joint body support 957 has a spring receiving groove 958 defined therein which provides a space for receiving a free end of the spring.

As shown in FIG. 9, the support body 94 has a support body through-hole 942 defined therein having a diameter larger than an outer diameter of the joint body 951 and smaller than an outer diameter of the joint body support 957. Thus, the joint body support 957 is supported on the support body 94 while the joint body 951 is inserted into the support body through-hole 942. The shaft-joint 95 is rotatably supported on the support body 94 while the joint body 951 passes through the support body through-hole 942 and the joint body support 957 is supported on the support body 94.

In one example, the power transmission 9 may further include a fixed body 91 fixed to the bottom face of the tub body 41 to provide a path of movement of the support body 94. The fixed body 91 may be secured to the bottom face of the tub body 41 via the bearing housing 39 (see FIG. 3).

The fixed body 91 includes a fixed body through-hole 912 through which the support body 92 passes, a side wall 912*a* defining an edge of the fixed body through-hole 912 and fixing the fixed body 91 to the tub body 31, a first receiving groove 913*a* and a second receiving groove 915*a* defined in the side wall 912*a*. The second receiving groove 915*a* may be arranged to face away the first receiving groove 913*a*.

In this case, at opposite sides of the support body 94, respectively, a first guide 946 and a second guide 947 may be formed so as to insert into the first receiving groove 913*a* and the second receiving groove 915*a*, respectively, to provide a path of movement of the support body 94.

The first guide 946 may include a first guide body 946*a* fixed to the support body and extending to be parallel to the direction of movement of the support body 94, and a first extension 946*b* extending from the first guide body in parallel to a bottom face of the first receiving groove 913*a*. The first extension 946*b* has a width such that the extension 946*b* is insertable into the first receiving groove 913*a*.

The second guide 947 includes a second guide body 947*a* fixed to the support body and extending be parallel to the direction of movement of the support body 94, and a second receiving groove 947*b* extending from the second guide body 947*a* in parallel to a bottom face of the second receiving groove 915*a*. The second extension 947*b* has a width such that the second extension 947*b* is insertable into the second receiving groove 915*a*.

In order to minimize movement of the support body 94 within the fixed body through-hole 912, the first guide 946 further includes a third extension 946*c* extending from the first extension 946*b*. The second guide 947 may further include a fourth extension 947*c* extending from the second extension 947*b*.

The third extension 946*c* may be formed by bending the first extension 946*b* toward the bottom face of the fixed body 91 so as to be parallel to the side wall of the fixed body 91. The fourth extension 947*c* may be formed by bending the second extension 947*b* toward the bottom face of the fixed body 91 so as to be parallel to the side wall of the fixed body 91.

The support body moving mechanism includes means for reciprocating the support body 94 between the bottom face of the tub body 31 and the rotor 713. That is, the support body moving mechanism includes means to adjust a vertical level of the support body so that the shaft-joint reciprocates between the first point and the second point.

As shown in FIG. 8, the support body moving mechanism includes first rack gears 931 and 933 disposed on the support body 94, pinions 961 and 963 rotatably disposed on the fixed body 91 and engaged with the first rack gears respectively, a pinion-driving system 97*a* reciprocating along a direction orthogonal to the moving direction of the support body 94, and second rack gears 9811 and 9831 to rotate the pinions 931 and 933 respectively when the pinion-driving system 97*a* moves.

The first rack gears 931 and 933 should extend parallel to the reciprocating direction of the support body 94. FIG. 9 shows an example in which the first rack gears include a first rack gear 931 of the support body disposed on the first guide body 946*a* and a second rack gear 933 of the support body disposed on the second guide body 947*a*. In this case, the pinions may include a first pinion 961 that is rotatably disposed on the side wall 912*a* and coupled to the first rack gear 931 of the support body and a second pinion 963 rotatably disposed on the side wall 912*a* and coupled to the second rack gear 933 of the support body.

As shown in FIG. 8, the pinion-driving system 97*a* includes a driving body 973*a* which reciprocates along a direction orthogonal to the direction of movement of the support body 94, a first bar 975*a* and a second bar 977*a* extend from the driving body 973*a* toward the first pinion 961 and the second pinion 963 respectively, a motor 971 fixed to the tub body 31, a rotating plate 9713 rotated by a rotating shaft 9711 of the motor, and a connecting bar 979*a* configured to connect the rotating plate 9713 with the driving body 973*a* and for converting the rotational motion of the rotating plate 9713 into a linear reciprocating motion of the driving body 973*a*.

As shown in FIG. 9, the fixed body 91 may has a communication hole 917 passing through the side wall 912. In this case, the first bar 975*a* and the second bar 977*a* may extend from the driving body 973*a* through the communication hole 917 to the first pinion 961 and the second pinion 963.

The second rack gear includes a first rack gear 9811 of the driving system disposed on the first bar 975*a* for rotating the first pinion 961, and a second rack gear 9831 of the driving system disposed on the second bar 977*a* for rotating the second pinion 963.

As shown in FIG. 2, the bottom face of the tub body 31 has a recess which is recessed toward the inside of the tub body. The bearing housing 39 or the stator 711 may be received in the recess (thereby, minimizing the volume of the tub). In this case, the motor 971 may be fixed to the bottom face of the tub body 31 out of the recess. The connecting bar 979*a* has a first bar extending parallel to the bottom face of the tub body 31 and connected to the rotating plate 9713, a second bar connected to the driving body 973*a*, and a bar connector for connecting the first bar to the second bar.

Hereinafter, an operation of the power transmission 9 having the above-described structure will be described.

As shown in FIG. 2, when the shaft-joint 95 connects the first serration 715 to the second serration 725 (that is, when the shaft-joint is positioned at the first point), the rotating plate 9713 is rotated by the motor 971 of the pinion-driving system as shown in FIG. 8. Thus, the connecting bar 979*a*, which is rotatably connected to the rotating plate 9713, will move in a direction away from the fixed body 91.

When the connecting bar 979*a* moves away from the fixed body 91, the driving body 973*a* rotatably coupled to the other end of the connecting bar 979*a* will move in a direction away from the support body 94.

When the driving body 973*a* moves in a direction away from the support body 94, the first bar 975*a* and the second bar 977*a* fixed to the driving body move in a direction away from the first pinion 961 and the second pinion 963. In this process, the first rack gear 9811 of the driving system and second rack gear 9831 of the driving system disposed on the bars 975*a* and 977*a* respectively rotate the first pinion 961 and the second pinion 963 respectively.

The first pinion 961 and the second pinion 963 are coupled to the first rack gear 931 of the support body and the second rack gear 933 of the support body respectively. Thus, when the first pinion 961 and the second pinion 963 are rotated, the support body 94 moves toward an upper space of the fixed body 91. That is, the support body moves toward the bearing housing disposed on the bottom face of the tub body.

When the support body 94 moves toward the upper space of the fixed body 91, the shaft-joint 95 moves together with the support body 94 toward the upper space of the fixed body. In this process, the shaft-joint 95 separates from the first serration 715 of the rotor 713 and moves to the second point (see FIG. 3). The restoring means 959 is compressed between the bearing housing 39 and the spring receiving groove 958.

In one example, when the motor 971 of the pinion-driving system changes the direction of rotation of the rotating plate 9713, the connecting bar 979*a* will move towards the fixed body 91. In this process, the shaft-joint 96 located at the second point will return to the first point.

When the motor 71 of the driving system works while the shaft-joint 95 is positioned at the first point as shown in FIG. 2, the laundry treating apparatus will rotate the drum body 41 and the agitator 6 in the same direction. However, when the motor 71 is actuated while the shaft-joint 95 is positioned at the second point as shown in FIG. 3, the drum body 41 and agitator 6 will rotate in different directions.

According to the present disclosure, the drum body 41 and the agitator 6 may rotate using the single driving system 7. Thus, a structure and a volume of the laundry treating apparatus may be minimized compared to a case where a driving system for rotating the drum body and a driving system for rotating the agitator are disposed separately.

Further, according to the present disclosure, the agitator 6 generates a stream of water inside the drum body 41. Thus, the water not only rubs laundry, but also blows the laundry directly. This may realize a laundry treating apparatus capable of maximizing the washing power while minimizing the volume thereof.

The abovementioned present disclosure is based on the case where the agitator-rotating shaft 76 includes the driving gear 761, the driven gear 763 and 765, the gear housing 766, the first shaft 767 and the second shaft 769. However, the present disclosure is not limited thereto. The agitator-rotating shaft 76 may be embodied as a single shaft connecting the rotor 713 and the hub 61 of the agitator. That is, although not shown in the drawing, the agitator-rotating shaft 76 may be inserted into the shaft through-hole 721 of the drum-rotating shaft, such that one end of the shaft 76 may be fixed to the hub 61, and the other end thereof may be fixed to the rotor 713.

FIG. 10 to FIG. 16 illustrate a laundry treating apparatus in accordance with another embodiment of the present disclosure.

Embodiments of the laundry treating apparatus as described below may have different structures of a tub, a drum, a driving system, and an agitator from those as described above. Hereinafter, different features will be mainly described.

Figure 10:
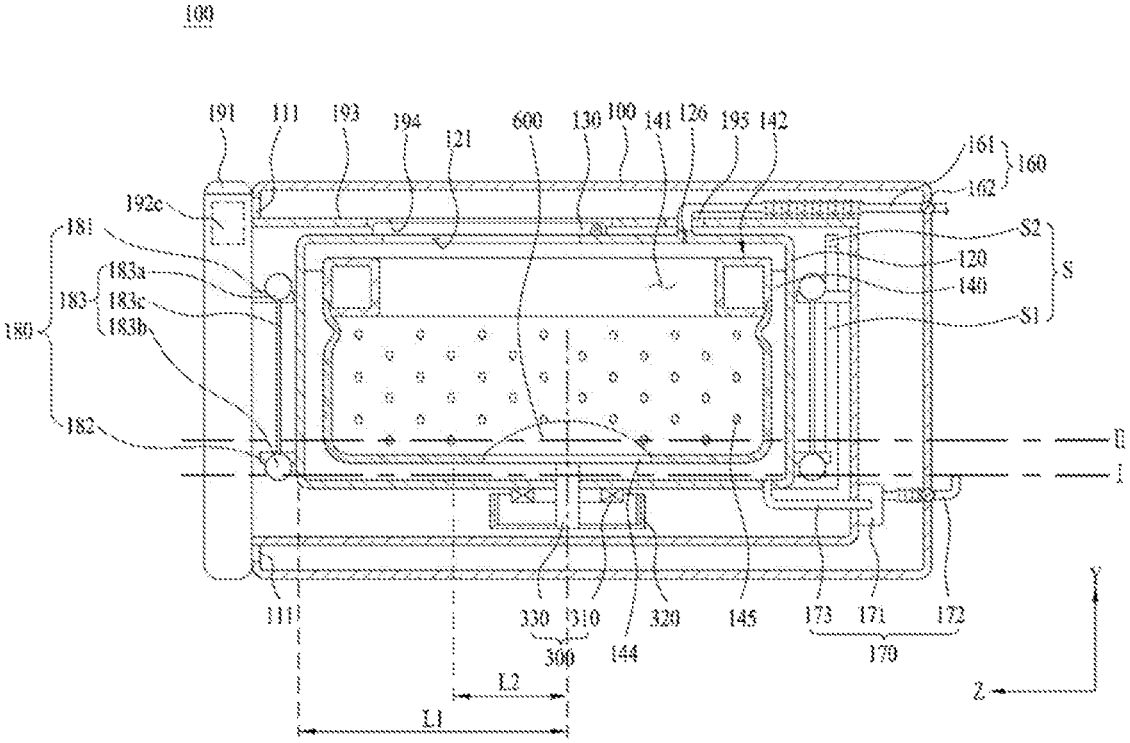
FIG. 10 to FIG. 16B illustrate a laundry treating apparatus in accordance with another embodiment of the present disclosure.

Referring to FIG. 10, a laundry treating apparatus 100 according to another embodiment of the present disclosure may be used as an auxiliary laundry treating apparatus and may be disposed above or below a main laundry treating apparatus. Thus, to enhance the accessibility of the main laundry treating apparatus or the accessibility of the auxiliary laundry treating apparatus, each of a tub 3 and a drum 4 of laundry treating apparatus in accordance with the present disclosure has a height smaller that a width. That is, each of the tub 3 and the drum 4 may be configured so that the height thereof is smaller than a diameter thereof.

The laundry treating apparatus 100 according to the present disclosure may be configured in a drawer type such that the main laundry treating apparatus or other auxiliary laundry treating apparatus is disposed above the laundry treating apparatus 100.

In one example, the tub 3 of the laundry treating apparatus 100 in accordance with the present disclosure has a height that is relatively smaller compared to a width, there is a possibility that water, laundry, and detergent supplied to the tub 3 may be discharged to the laundry inlet 33.

To prevent this problem, the laundry and treating apparatus 100 in accordance with the present disclosure may further include a door 35, which may open and close the laundry inlet 33. The door 35 may include a frame 131 shaped to correspond to a shape of the laundry inlet 33, a window 133 disposed inside the frame 131 to allow the user to check a state inside the tub 3, and a coupling portion 135 which may fix the frame and window when the laundry inlet 33 is closed by the frame and window.

The coupling portion 135 may be provided with a handle 134 which may open the door easily.

In one example, the door 35 may further include a door body 136 which may extend from an outer circumferential surface of the frame 131 to maximize a closing effect of the laundry inlet 33.

In one example, the laundry treating apparatus 100 may include a support 180 for supporting the tub 3 in the cabinet 1 or the drawer 2, and for attenuating vibration generated from the tub 3 so that the vibration is not transmitted to the cabinet 110.

The support 180 may be embodied as a damper, or as a spring, or as a combination of a damper and a spring. The support 180 may be embodied as dampers, or as springs, or as a combination of dampers and springs.

The support 180 may be disposed above and/or below the tub 3. However, since the laundry treating apparatus 100 according to the present disclosure may be embodied as an auxiliary laundry treating apparatus, the height thereof is limited. Thus, the support 180 is preferably disposed on a side face of the tub 3.

The support 180 includes a first support 181 disposed on the inner side of the cabinet 1 or the drawer 2, a second support 182 disposed on the outside of the tub 3, and a connector 183 for connecting the first support 181 and the second support 182.

The first support 181 is disposed above the second support 182. The connector 183 may be fixedly coupled at one end thereof to the first support 181, while the other end of the connector 183 may support the second support 182. As a result, the tub 3 may be fixed and supported onto the cabinet 1 or the drawer 2.

The first support 181 may be embodied as a first bracket protruding from the cabinet 1 or the drawer 2. The second support 182 may be embodied as a second bracket protruding from the tub 3. The connector 183 may be configured to connect the first bracket with the second bracket. In this connection, the connector 183 may extend in a vertical direction of the drum 4 from the ground or the bottom face 144 of the drum 4. This may minimize a volume of the support 180 including the connector 183 to further expand the wash volume of the tub 3.

The connector 183 includes a first connector 183*a* passing through the first support 281 and being seated thereon, a second connector 183*b* passing through and supporting the second support 182, and a connecting bar 183*c* for connecting the first connector 183*a* and the second connector 183*b*.

Each of the first connector 183*a* and the second connector 183*b* may be configured to be larger in a diameter than a diameter of the connecting bar 183*c* and may be formed into a disk, a hemisphere, a sphere, or the like. This allows the connector 183 to be stably coupled to the first support 181 and the second support 182.

In one example, one side of the tub 3 may be provided with a water-level sensor S for sensing the water-level of the tub 3. A temperature sensor may be placed on the inner circumference of the tub 3 to sense the temperature of the tub 220.

The water-level sensor S includes a sensor tube S1, which communicates with the inside of the tub 3 at one side of the tub 3, and extends upwardly, and a diode S2 on which the sensor tube is disposed, wherein the diode S2 senses a pressure inside the sensor tube. However, the present disclosure is not limited thereto. As long as the water-level of the tub 3 can be measured by the sensor S, the sensor S may be configured in any shape and structure.

The water-level sensor S may sense whether the water level of the tub 3 has reached a first water-level I, which may correspond to a bottom face 144 of the drum. The water-level sensor S may sense whether the water level of the tub 3 has reached a second water-level II. When the water level of the tub 3 has reached the second water-level II, water may be exposed to a top of the agitator 6.

Specifically, the first water-level I may correspond to the water-level between the bottom face 127 of the tub and the bottom face 144 of the drum. The second water-level II may correspond to the water-level between the bottom face 144 of the drum and the highest point of the agitator 6.

In one example, the laundry treating apparatus 100 may include a second driving system 300 that rotates the drum 4 on the tub 3.

The second driving system 300 includes a driving stator 310 fixed to a bottom face 127 of the tub 3 to generate a rotating magnetic field, a driving rotor 320 rotated by a rotating magnetic field from the driving stator 320, and a rotating shaft 330 passing through the tub 3 and rotated by the rotor.

In one example, the drum 4 may have a further laundry inlet 141 in communication with the laundry inlet 33. The drum 4 may have a balancer 142 coupled to the outer circumferential surface of the further laundry inlet 141 to prevent eccentricity of the drum 4.

In one example, the inner circumferential face of the drum 4 may have a plurality of hollows 145 defined therein through which the water in the tub 3 enters or exits.

The drum 4 may be rotated by the power provided by the second driving system 300. The drum 4 may wash the laundry stored in the drum 4 by applying mechanical power to the laundry.

Further, the drum 4 may be rotated by the power provided by the second driving system 300 to carry out a spinning cycle to discharge the moisture contained in the laundry to the hollows 145.

In one example, the drum bottom face 144 has a through-hole 144*a* defined therein. The apparatus 100 may have an agitator 6 rotatably disposed in the through-hole 144*a*.

The agitator 6 may be configured to rotate separately from the drum 4 to stir laundry. In other words, the agitator 6 can wash the laundry by applying a mechanical force to the laundry stored in the drum 4 while rotating separately from the drum 4. The agitator 6 may receive a power from the second driving system 300 and repeat the clockwise and counterclockwise rotations, to form a strong stream of water inside the drum 4.

The agitator 6 is preferably rotated while water and laundry are stored in tub 3. This is because when the agitator 6 rotates while no water is present in the tub 3, the laundry may be damaged due to a direct contact thereof with the agitator 6. Therefore, the agitator 6 may rotate independently in the washing cycle where laundry is washed using water and detergent.

Further, when water is absent in the tub 3, or when the water level in the tub 3 is low, it is preferable for the agitator 6 to rotate together with the drum 4. Therefore, the agitator 6 and the drum 4 may be rotated in the same direction in the spinning cycle, in which the centrifugal force is generated to remove the water from the laundry In one example, the agitator 6 may be rotated independently of the drum 4, or together with the drum 4 according to various situations. To this end, a separate brake or clutch is disposed. This may lead to a drawback that the height of the cabinet 1 may be increased due to the volume occupied by the brake or the clutch, or the washing capacity of the tub 3 may be reduced. Furthermore, a separate algorithm is needed to actively control the brake or clutch, causing the controller's load to rise up.

Therefore, it is necessary to be able to control the rotation of the agitator 6 and the drum 4 even when an additional component such as a clutch or a brake or a separate control algorithm is omitted.

Hereinafter, a structure of a vertically-movable assembly S will be described. The vertically-movable assembly S may allow whether to rotate the agitator 6 and the drum 4 to be automatically determined according to the water-level change of the tub 3. Thus, a component such as the brake or clutch is omitted. Further, an additional algorithm for actively controlling the rotation of the agitator 6 and drum 4 may be omitted.

Figure 11:
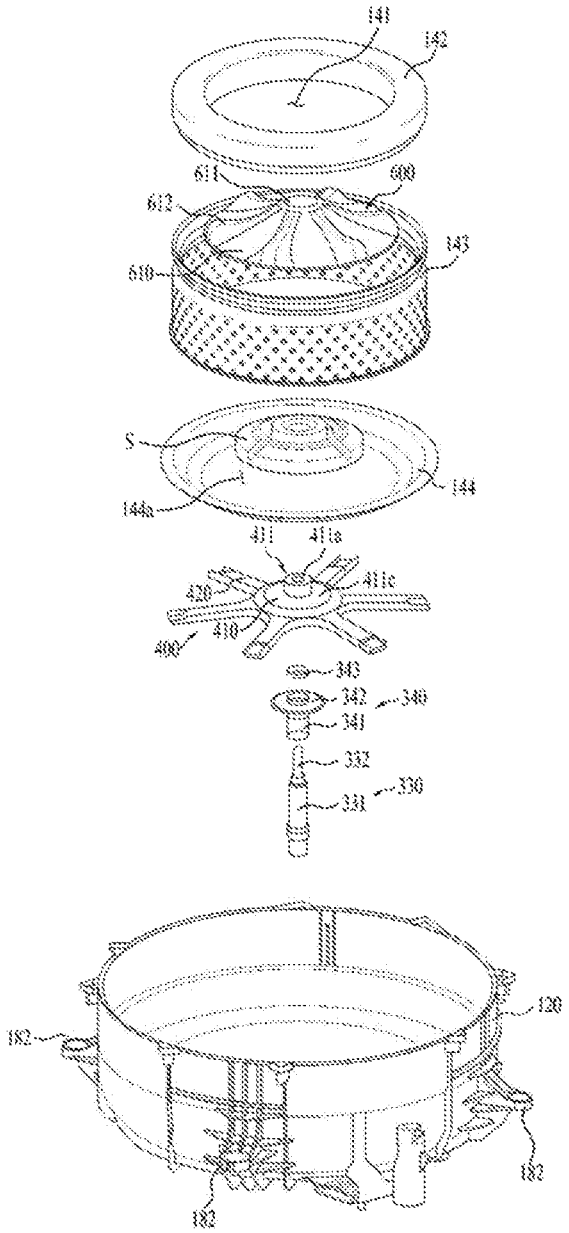

FIG. 11 shows an exploded perspective view of the drum 4 including the vertically-movable assembly S.

Referring to FIG. 11, the agitator 6 includes an agitator body 610 constituting a main body, a central portion 611 disposed at a center of the agitator body, and agitating arms 612 protruding radially from the central portion 611 for agitating laundry.

The drum 4 may include a drum body 143 constituting a main body and a drum bottom face 144 coupled to a bottom of the drum body 143 to define a bottom of the drum 4.

The drum body 143 may be formed in a cylindrical shape having an open top and an open bottom. The drum bottom face 144 may have a through-hole 144*a* defining the inner circumferential face thereof. The hole 144*a* may define a space in which the agitator 6 may rotate.

The agitator 6 may be coupled directly to the rotating-shaft 330 and rotate together with the rotating-shaft 330. In this connection, the drum 4 cannot rotate independently of the agitator 6 when the drum is directly coupled to the rotating-shaft 330. Thus, the drum 4 may be configured to be coupled indirectly to and rotate indirectly with the rotating shaft 330 so that the drum 4 may be selectively rotated.

To this end, the rotating-shaft 330 may include a shaft-body 331 that is directly rotated by the driving rotor 320 and a shaft gear 332 that may rotate in direct conjunction with the agitator 6.

In one example, the driving system 300 may further include a shaft-receiving assembly 340, which may rotatably receive the shaft-body 331 or the shaft gear 332 therein. In other words, the shaft-receiving assembly 340 may be configured to rotatably receive at least a portion of the rotating-shaft 330 but not to rotate together with the rotating-shaft 330. Thus, the shaft-receiving assembly 340 may be formed in a cylindrical shape that may be configured larger in an inner diameter than an outer diameter of the rotating-shaft 330.

In one example, the shaft-receiving assembly 340 may be coupled to the bottom face of the drum 4 and may support and receive the rotating-shaft 330 therein.

The shaft-receiving assembly 340 includes a shaft-receiving tube 341 that rotatably receives a portion of the rotating-shaft 330, a shaft-fastening portion 344 that extends from the top of the shaft-receiving tube 341 and is coupled to a bottom of the drum 4. Thus, the rotating-shaft 330 may be rotated independently of the shaft-receiving assembly 340 not to transmit the power from the second driving system 300 directly to the drum 4.

The present laundry treating apparatus 100 includes a first vertically-movable assembly 500 disposed between the agitator 6 and the second driving system 300 or the bottom face 144 of the drum 4 and configured to receive power from the second driving system 300 and rotate using the received power.

The vertically-movable assembly S may be coupled to the rotating shaft 331 and configured to rotate together with the rotating shaft 331.

The vertically-movable assembly S rotates the agitator 6 when the water level in the tub 3 is above a certain water level. When the water level in the tub 3 is below a certain water level, the vertically-movable assembly S rotates the agitator 6 and the drum 4 in the same direction.

The vertically-movable assembly 500 may be made of a material having a specific gravity smaller than that of water. For example, the vertically-movable assembly 500 may be made of as a plastic material, or may be made of as engineering plastics or reinforced plastics for stiffening reinforcement. Thus, when water is supplied to the tub 3, the vertically-movable assembly 500 may rise toward the agitator 6. When the water in the tub 3 is drained therefrom, the vertically-movable assembly 500 may descend in a direction away from the agitator 6.

In general, the washing cycle, which removes impurities from laundry by applying mechanical force to laundry, may be performed when the water level in the tub 3 is above the second water-level II. The spinning cycle, in which the drum 4 is rotated at high speed to remove the moisture contained in the laundry therefrom, may be performed when the water level in the tub is below the second water-level II or below the first water-level I (see FIGS. 13A and 13B).

Thus, the vertically-movable assembly S may rotate only the agitator 6 in the washing cycle. In the spinning cycle, the vertically-movable assembly S may rotate the agitator 6 and the drum 4 in the same direction. Whether the agitator 6 should be independently rotated may be determined depending on the water-level in the tub 3.

In one example, the laundry treating apparatus 100 may further include a shaft-fixed assembly 400 to which the shaft-receiving assembly 330 is coupled and which is coupled to the drum 4 and disposed around the through-hole 144*a* of the drum 4.

That is, the rotating-shaft 330 may be configured to rotate by the driving stator 310 and the driving rotor 320, but to indirectly rotate the shaft-fixed assembly 400 via the shaft-receiving assembly 340.

In other words, the rotating shaft 330 rotates freely in the shaft-receiving assembly 340. The rotating shaft 330 may pass through a hub 410 of the shaft-fixed assembly 400 and a hollow portion 411 thereof. Further, the agitator 6 may be coupled to a distal end of the rotating shaft 330 and may be rotated together with the rotating shaft 330. The power generated by the driving system 300 may be transmitted directly to the agitator 6, but the shaft-fixed assembly 400 is not directly powered by the driving system 300.

The shaft-fixed assembly 400 may be coupled to the drum 4 and may be disposed around the through-hole 144*a* of the drum 4. Accordingly, when the shaft-fixed assembly 400 rotates, the drum body 143 may rotate. When the shaft-fixed assembly 400 stops, the drum body 143 may stop.

In this connection, when the water level in the tub 3 is below the second water-level II, the vertically-movable assembly 500 couples to the shaft-fixed assembly 400 to transmit the power of the driving system 300 to the drum 4. When the water level in the tub 3 is above a certain water level, the vertically-movable assembly 500 may be configured to be isolated from the shaft-fixed assembly 400 to prevent the power transmission to the drum 4 (See FIGS. 13 and 16).

Specifically, when the water level of the tub 3 is above the second water-level II, the vertically-movable assembly S separates from the shaft-fixed assembly 400 and ascends toward the agitator 6. When the water level of the tub 3 is below the second water-level II. the vertically-movable assembly S may be configured to be lowered and coupled to the shaft-fixed assembly 400. The vertically-movable assembly 500 may be directly powered by the driving system 300. Thus, when the water level in the tub 3 is above the second water-level, the assembly 500 is combined with the agitator 6 to rotate only the agitator 6. When the water level of the tub 3 is below the second water-level, the shaft-fixed assembly 400 may be coupled to the shaft-fixed assembly 400 to rotate the shaft-fixed assembly 400 (See FIGS. 13A, 13B, and 16).

The shaft-fixed assembly 400 may include a hub 410 to which the shaft-receiving assembly 340 is coupled at a bottom of the hub, and fixing arms 420 extending radially from the hub 410 and coupled to the bottom face 144 of the drum.

Further, the shaft-fixed assembly 400 may further include a hollow portion 411 extending upwardly from the hub 410 to receive at least a portion of the shaft gear 331 and spaced a certain distance from the shaft gear 311.

Figure 12:
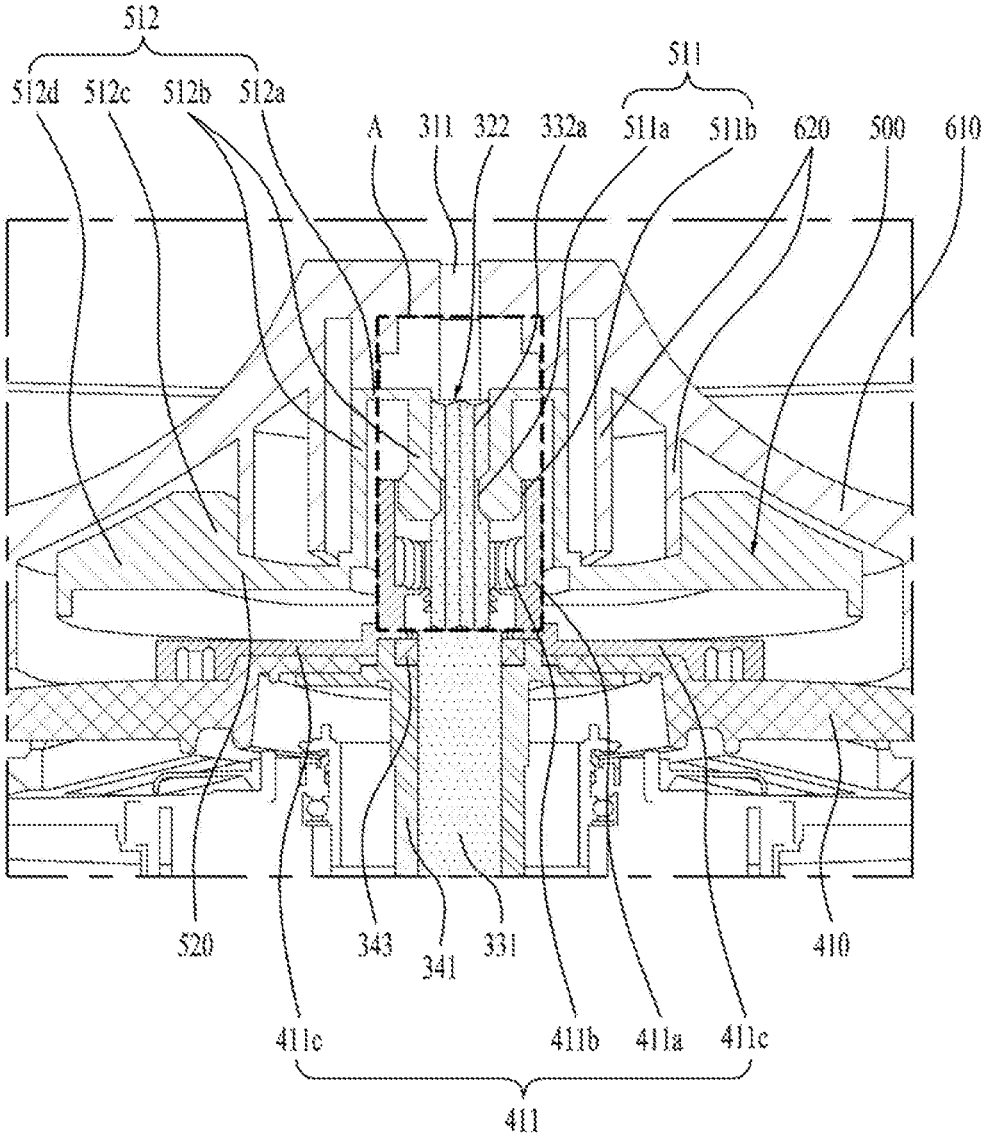

FIG. 12 shows a detailed structure of a first vertically-movable assembly 500 as an embodiment of a vertically-movable assembly S.

Referring to FIG. 12, the first vertically-movable assembly 500 may include a power transmission 510 that is coupled to the rotating-shaft 330 to transmit the power of the second driving system 300. The power transmission 510 may include a first vertically-movable gear hollow portion 511 coupled to the rotating shaft 330 to rotate with the rotating shaft 330.

Further, the-rotating shaft 330 may have a first gear 332*a*, which may engage with an inner circumferential surface of the first vertically-movable gear hollow portion 511 and which may be present in an exposed portion of the shaft 330 above the hub 410.

In one example, the hollow portion 411 may include a hub gear hollow portion 411*a* that receives at least a portion of the shaft gear 332, but is spaced a distance from the shaft gear 322. The hub gear hollow portion 411*a* has a second gear 411*b* on an inner periphery thereof.

The first vertically-movable gear hollow portion 511 has a third gear 511*a* meshing with the first gear 332*a* and formed on an inner circumference of the portion 511 and configured to move along a length direction of the shaft gear 332. The first vertically-movable gear hollow portion 511 has a fourth gear 511*b* disposed on an outer circumference thereof to engage with the second gear 411*b* when the portion 511 is inserted between the shaft gear 332 and the hub gear hollow portion 411*a*.

The first vertically-movable gear hollow portion 511 ascends along the length of the shaft gear 332 when water enters the tub 3. When water is drained from the tub 3, the portion 511 may be lowered along the length of the shaft gear 332 and then inserted into between the shaft gear 332 and the hub gear hollow portion 411*a*.

That is, the first vertically-movable gear hollow portion 511 may receive the power of the rotating shaft 330 directly therefrom because the third gear 511*a* thereof engages the first gear 322*a* of the shaft gear 332.

Figures 13A, 13B:
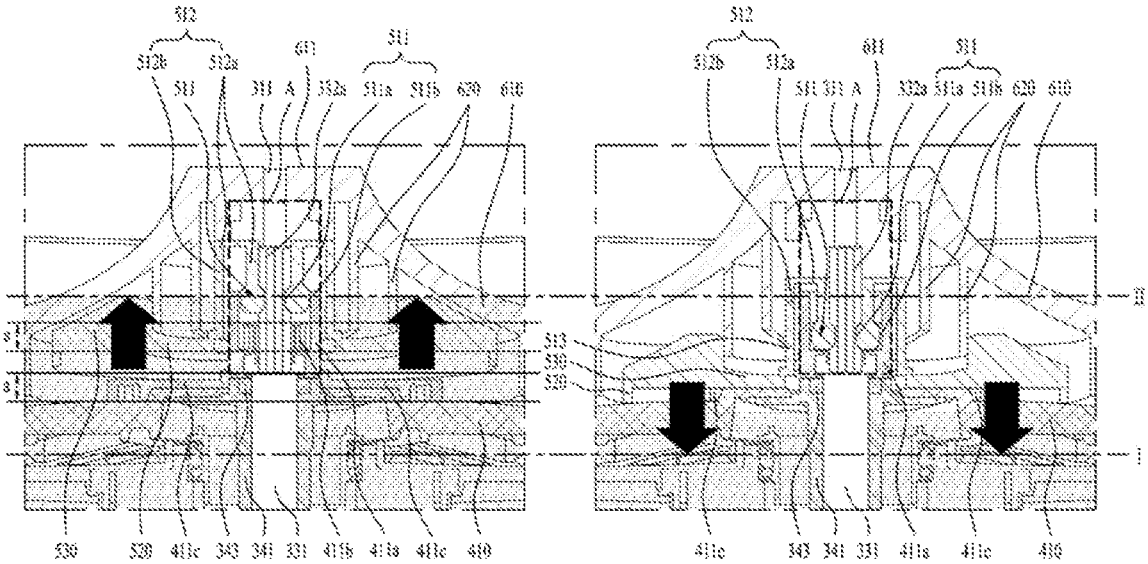

Thus, when the first vertically-movable gear hollow portion 511 is inserted between the shaft gear 332 and the hub gear 441*a*, and when water is input to the tub 3 such that the water level of the tub 3 is above a certain water level, the first vertically-movable gear hollow portion 511 may be separated away from the shaft gear 332 and the hub gear 441*a* and thus rise up (see FIGS. 13A and 13B).

Therefore, even when the shaft gear 332 rotates, the hub gear 441*a* does not rotate and the shaft-fixed assembly 400 and the drum 4 do not rotate. In this connection, when the first vertically-movable gear hollow portion 511 contacts the bottom of the agitator 6, the first vertically-movable assembly 500 may rotate the agitator 6 although the agitator 6 is indirectly coupled to the shaft 330 so as not to rotate directly by the rotating shaft 330. When the agitator 6 is fixed on the top of the shaft gear 332, the agitator 6 may rotate continuously with the rotating shaft 330.

Therefore, in the washing cycle, the drum 4 is fixed and only the agitator rotates. Thus, the water stream inside the drum 4 may be formed to improve the washing efficiency.

Further, when the water in the tub 3 is drained therefrom and the water level in the tub 3 is below the second water-level, the first vertically-movable gear hollow portion 511 may be inserted into between the shaft gear 332 and the hub gear 441*a* (see FIGS. 13A and 13B).

In this connection, the fourth gear 551*b* of the first vertically-movable gear portion 511 is coupled to the second gear 411*b* of the hub gear portion. Thus, when the first vertically-movable assembly 500 is rotated by the shaft gear 332, the assembly 500 may rotate the hub gear hollow portion 411*a*.

Thus, the first vertically-movable gear hollow portion 511 may transmit power generated by the driving system 300 to the shaft-fixed assembly 400 via the hub gear hollow portion 411*a*, thereby rotating the drum 4. In this connection, the agitator 6 may rotate with the shaft gear 332, so that the agitator 6 and the drum 4 may rotate at the same time.

Thus, in the spinning cycle, the agitator 6 and drum 4 may rotate together, so that a degree of laundry twisting may be relaxed.

In one example, the first vertically-movable assembly 500 may further include a movable structure 512 that may move the first vertically-movable gear hollow portion 511. The movable structure 512 may include a movable plate 512*a* extending from the top of the first vertically-movable gear hollow portion 511 wherein the first vertically-movable gear portion 511 is fixed to the movable plate 512*a*, and a movable rib 512*b* extending from a distal end of the movable plate 512*a* to detachably receive the hub gear hollow portion 411*a*.

That is, the movable ribs 512*b* and the movable plate 512*a* may be spaced to define a space to accommodate the hollow portion 411*a*. For this purpose, the movable plate 512*a* may be disposed above the first vertically-movable gear hollow portion 511, or may extend further upwards from the top of the first vertically-movable gear hollow portion 511. Thus, the movable plate 512*a* may be positioned above the first vertically-movable gear hollow portion 511, and the movable ribs 512*b* may be further elongated in a vertical direction at each of both ends of the movable plate 512*a*. Further, the hub gear hollow portion 411*a* may be further extended upwards above the second gear 411*b*. That is, in a region of the hub gear hollow portion 411*a* disposed above the second gear 411*b*, the hub gear hollow portion 411*a* may be formed into a separate tubular shape without gears on the inner peripheral surface thereof.

Thus, the air contained in a first space A defined by a combination of the movable plate 512*a*, the movable rib 512*b*, the hub gear hollow portion 411*a*, and the bottom of the agitator 6 may be prevented from exiting out of the agitator 6 or out of the first vertically-movable assembly 500 when the water is input to the tub 3.

Thus, the air contained in the space A defines an air gap, thereby preventing water from entering the rotating shaft including the shaft gear 322 or the shaft-body 331. That is, even when water is supplied to a top level of the agitator 6 in the tub 3, the air contained in the first space A is prevented from escaping out due to the confinement by the movable plate 512*a*, the movable rib 512*b*, and the hub gear hollow portion 411*a*. Thus, this may perform shaft sealing to prevent water from entering. Thus, even when an actual sealing member is omitted, water may be prevented from flowing into the driving system 300.

In this connection, the larger the height of the first space A, the more difficult it is for the air in the first space A to escape. Thus, it may be advantageous for the hub gear hollow portion 411*a* and the movable rib 512*b* to be positioned to be a higher level.

For this purpose, it may be desirable for the agitator 6 to have the central portion 611 at a higher vertical level.

In one example, the movable structure 512 may further include an extended rib 512*c* extending from the movable rib 512*b*, and an agitating contact portion 512*d* protruding from the distal end of the extended rib and configured to be detachably coupled to the bottom of the agitator 6.

The agitating contact portion 512*d* and the extended rib 512*c* may define a space into which water may flow from below or which contact water below, so that the first vertically-movable assembly 500 may float more readily on the water.

In one example, the agitator 6 may protrude upwards such that below a central portion 611 thereof, a space is defined into which the first vertically-movable assembly 500 is detachably received. Further, the agitator 6 may further include a reference tube 620 that extends downwardly from the central portion 611 and is configured to be able to be seated on the extended rib 512*c* to receive the first vertically-movable gear hollow portion 511.

As a result, the agitator 6 may have enhanced contact with the first vertically-movable assembly 500. Unlike the above, the agitator 6 may not be fixed to the-rotating shaft 330 but may be coupled freely rotatably to the-rotating shaft 330. In this case, the agitator 6 contacts the first vertically-movable gear hollow portion 511, the agitating contact portion 512*d*, and the extended rib 512*c* of the first vertically-movable assembly 500. Thus, when the first vertically-movable assembly 500 rotates, the agitator 6 may rotate together therewith.

In one example, the shaft-receiving assembly 340 may further include a receiving bearing 343. The receiving bearing 343 is disposed on the inner circumferential surface of the shaft-receiving tube 341 to prevent the power of the-rotating shaft 330 from being transmitted to the shaft-receiving assembly 340 while inducing free rotation of the rotating shaft 330.

In one example, the hollow portion 411 may further include a hub contact portion 411*c*. The hub contact portion 411*c* may be disposed separately from the hub 410 and may be detachably attached to the hub 410. The hub contact portion 411*c* may extend from an outer circumferential surface of the hub gear 411 and may be coupled to the hub 410.

This is because the shape of the hub 410 is complicated. Due to the presence of the hub contact portion 411*c*, it may be easy to form or manufacture the hub 410 including the hollow portion 411 ata time.

FIGS. 13A and 13B show a positional change of the first vertically-movable assembly 500 according to the water-level of the tub 3.

Referring to FIG. 13A, when the water level in the tub 3 is above the second water-level II, water flows to the bottom of the first vertically-movable assembly 500 and thus the first vertically-movable assembly 500 rises up. In this connection, the first vertically-movable assembly 500 may rise until the top of the first vertically-movable assembly 500 contacts the bottom of the center 610 of the agitator.

The first vertically-movable assembly 500 is rotated by the shaft gear 332 so that the agitator 6 can be rotated. However, since the first vertically-movable assembly 500 is separated from the hub gear 411, the shaft-fixed assembly 400 is not rotated.

Thus, when the water level of the tub 220 is above the second water-level II, only the agitator may rotate. In this connection, when the washing cycle is in progress, water stream may be formed inside the drum 4 and then steam may impact with the laundry at a suitable strength to increase the cleaning efficiency.

Referring to FIG. 13B, when the water level of the second tub 220 is below a certain water level, the first vertically-movable assembly 500 descends as the water is discharged from the bottom of the first vertically-movable assembly 500. In this connection, the assembly 500 descends until the power transmission 510 of the first vertically-movable assembly 500 is inserted between the hub gear hollow portion 411*a* and the shaft gear 332.

In this connection, the first vertically-movable assembly 500 is rotated by the rotation of the shaft gear 332. Thus, the first vertically-movable assembly 500 rotates the hub gear hollow portion 411*a*.

Further, when the agitating contact portion 512*d* of the first vertically-movable assembly 500 sufficiently protrudes and the reference tube 620 of the agitator 6 contacts the top face of the first vertically-movable assembly 500, the first vertically-movable assembly 500 may rotate the agitator 6 while the assembly 500 is rotating.

Further, when the central portion 611 of the agitator 6 is fixed to the top of the shaft gear 332, the agitator 6 may rotate with the rotation of the shaft gear 332.

In this connection, the shaft gear 332 and the first vertically-movable gear hollow portion 511 and the hub gear hollow portion 411*a* may rotate at the same angular velocity.

Therefore, the shaft-fixed assembly 400 and the agitator 6 rotate at the same time. Thus, the same effect as that when the shaft and the agitator is directly coupled to each other can be obtained.

When the spinning cycle is in progress, the drum 4 and the agitator 6 rotate all at the same time, so laundry kinks may be mitigated to prevent laundry damage.

In one example, in order to prevent the first vertically-movable assembly 500 from lifting up and thus from transferring the power to the drum 4, the first vertically-movable gear hollow portion 511 must be completely separated from the second gear 411*b* of the hub gear hollow portion 411*a*. In other words, in order to prevent the first vertically-movable assembly 500 from transmitting the power to the drum 4 and thus to alloy only the rotation of the agitator 6, the first vertically-movable assembly 500 should rise up at least to a vertical level of the second gear 411*b*.

Thus, a minimum vertical dimension (a) at which the first vertically-movable assembly 500 may be completely separated from the drum 4 may be defined to correspond to a vertical dimension of the second gear 411*b* of the hub 410.

Figure 14:
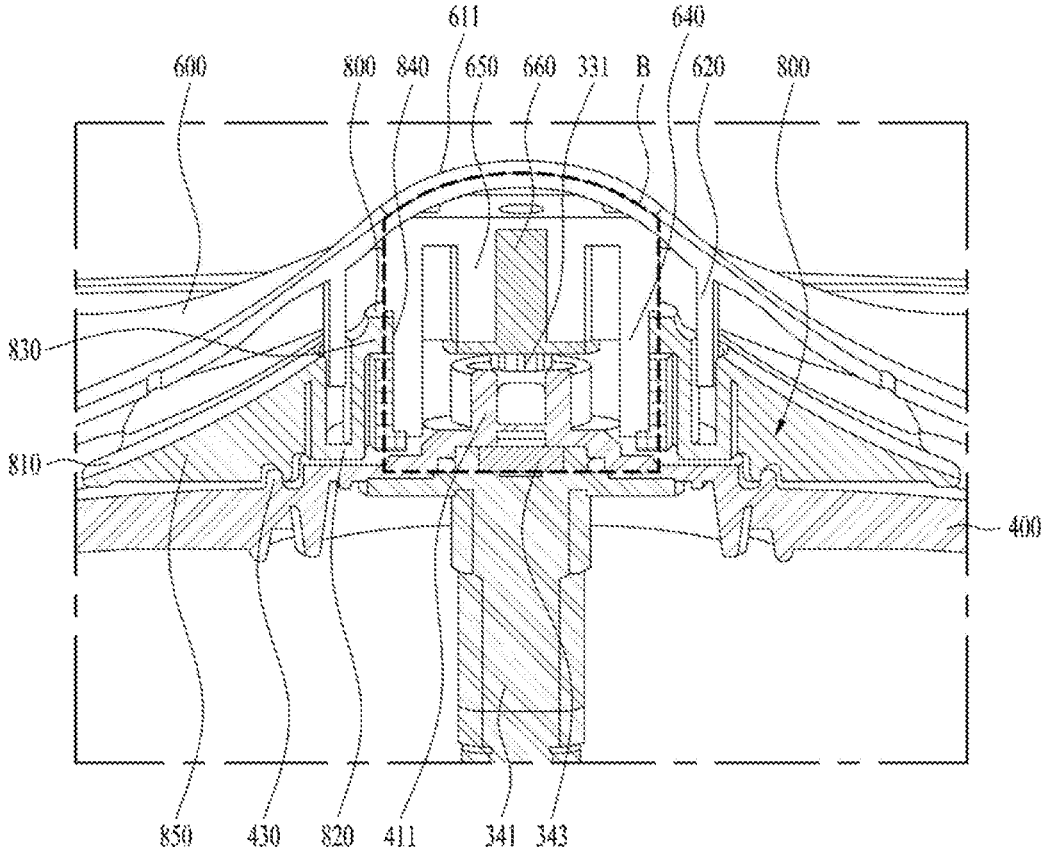

FIG. 14 shows a second vertically-movable assembly 800 as another embodiment of the vertically-movable assembly S.

In the following description, differences between the first vertically-movable assembly 500 from the first embodiment and the second vertically-movable assembly 800 will be focused on.

The second vertically-movable assembly 800 is configured to be prevented from contacting or being coupled to the rotating shaft 330, which is unlike the first vertically-movable assembly 500. In other words, the second vertically-movable assembly 800 may be configured to ascend and descend while being separated from the-rotating shaft 330.

In FIG. 14, it is shown that the rotating shaft 330 has a rotating shaft gear 331 to be engaged with a contact portion 650 of the agitator 6 to be described later. However, the present disclosure is not limited thereto. In another example, since the second vertically-movable assembly 800 is configured so as not to receive power from the rotating shaft 330, the rotating shaft 330 may be free of the rotating shaft gear 331.

Further, in the hollow portion 411, the hub gear hollow portion 411*a* may be completely omitted. In an alternative, only a smooth portion of the hub gear hollow portion 411*a* may be left, and the second gear 411*b* may be omitted.

Therefore, since the complicated structure of the hub gear hollow portion 411 may be avoided, it is not necessary to undergo a separate molding process to form the hollow portion 411. Thus, the hub gear hollow portion 411 may be integral with the hub 410. Further, in the hub 410, the fixing arms 420 extend radially to extend to the bottom face 144 of the drum. Thus, the fixing arms 420 and the hollow portion 411 may be integrally formed to each other. As such, the shaft-fixed assembly 400 may be formed into a single piece.

The second vertically-movable assembly 800 may include a vertically-movable body 810 that is configured to contact the bottom of the agitator 6 as it ascends, and a shaft-receiving hole 830 passing through the vertically-movable body 810 and configured to receive the—rotating shaft.

The shaft-receiving hole 830 may be configured to be larger in a diameter than an outer diameter of the-rotating shaft 330 so that an inner face defining the hole 830 is not in contact with the-rotating shaft 330 but is always spaced apart from the shaft 330.

The agitator 6 may further include a guide tube 640. The guide tube 640 extends from the bottom of the agitator to contact the inner circumferential surface 840 defining the shaft-receiving hole 830 and thus guides the vertical-movement of the vertically-movable body 810. The guide tube 640 may confine therein air beneath the agitator 6 to form an air gap to prevent water from entering the driving system 330. Thus, the second vertically-movable assembly 800 may be configured to contact the agitator 6 for vertical-movement, rather than being in contact with the—rotating shaft 330 for vertical-movement. Thus, although the second vertically-movable assembly 800 is not guided by the-rotating shaft 330, the assembly 800 is guided by the agitator 6. This allows the second vertically-movable assembly 800 to contact or separate from the agitator 6 more accurately. Further, since the agitator 6 and the second vertically-movable assembly 800 can be manufactured into a single module, the structure of the present apparatus may be further simplified. Further, the second vertically-movable assembly 800 may be less likely to malfunction.

Further, since the second vertically-movable assembly 800 need not be directly engaged or in a contact with the-rotating shaft 330, it is not necessary to dispose a separate component on the inner circumference of the guide tube 640. In other words, in the second vertically-movable assembly 800, a configuration in which the components such as the vertically-movable assembly gear hollow portion 511, the movable plate 512*a*, and the movable rib 512*b* in the first vertically-movable assembly 500 contact or are adjacent to the-rotating shaft 330 may be omitted.

In the second vertically-movable assembly 800, a corresponding portion of the interior of the guide tube 640 defines the shaft-receiving hole 830. Thus, the agitator 6 may be configured such that an entirety of the space inside the guide tube 640 may be defined as a second space B to collect air therein. Moreover, since the guide tube 640 extends downward from the central portion 611 of the agitator 6, the air on the inner circumferential surface of the guide tube 640 does not leak out even when water is introduced to the tub.

Thus, in the second vertically-movable assembly 800, even when components such as the movable plate 512*a*, movable rib 512*b*, and the configuration in which the hub gear hollow portion 411*a* extends over the second gear 411*b* are omitted, the air in the second space B may be prevented from flowing out even when water enters the tub 3.

The guide tube 640 may also serve as an air gap or axis seal to prevent the air in the second space B from entering the rotating shaft 330.

At the same time, the overall height of the vertically-movable assembly 500 may be lowered. The height of the protrusion of the central portion 611 protruding from the agitator 6 to accommodate the assembly 500 may also be lowered. Moreover, as the second space B is defined as the shaft-receiving hole 830, the air receiving space has a width larger than that of the first space A. Thereby, it is possible to secure an amount of air greater that the amount of air that may be collected in the first space A. Therefore, in the laundry treating apparatus according to the present disclosure having the second vertically-movable assembly 800, the effect of the air gap or shaft sealing may be reliably derived or enhanced.

The central portion 611 may protrude upward such that, under the central portion 611 of the agitator, an air gap may be defined to prevent water from entering the vertically-movable assembly or the driving system. The central portion 611 has a contact portion 650 to be described later below the central portion 611. The contact portion 650 is received in the guide tube 640 and coupled with the-rotating shaft 330.

In order for the contact portion 650 to receive maximum power from the-rotating shaft 330, a gear corresponding to the rotating shaft gear 331 may be disposed on the inner circumferential surface of the contact portion 650.

Figure 15A:
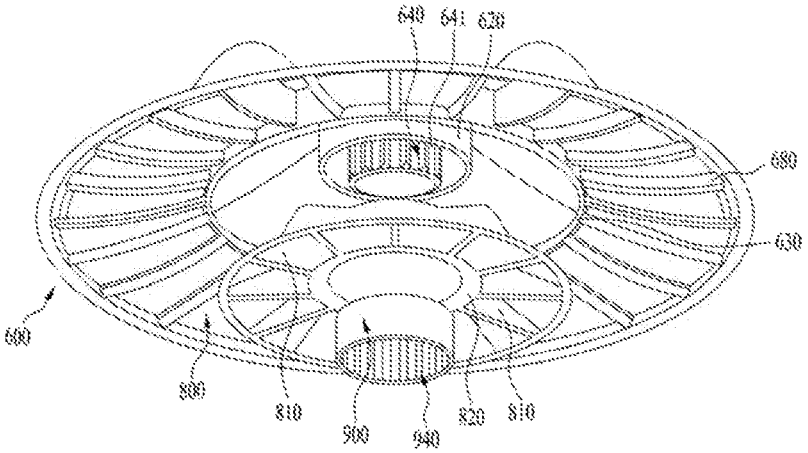
Figure 15B:
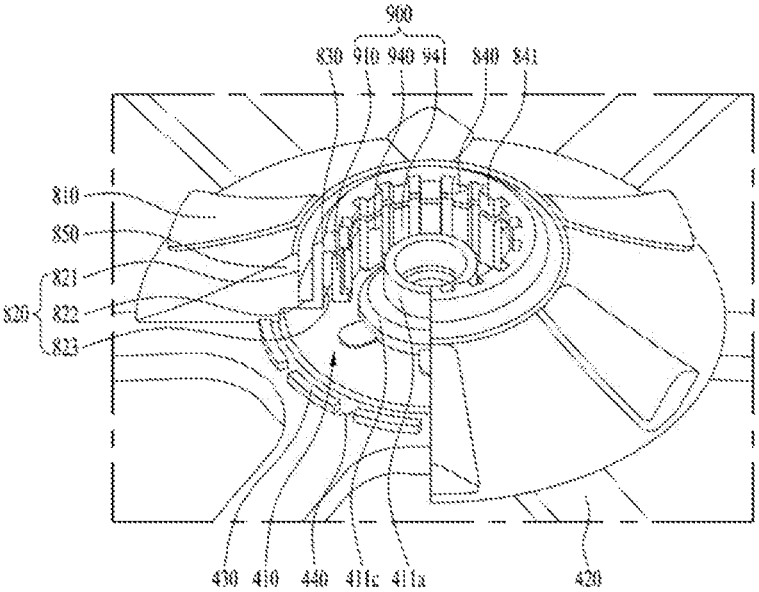

FIGS. 15A and 15B show a detailed structure of the second vertically-movable assembly 800 in accordance with the present disclosure.

FIG. 15A shows the agitator 6 when viewed from below. FIG. 15B shows a structure in which the second vertically-movable assembly 600 is seated on the shaft-fixed assembly 410.

The laundry treating apparatus according to the present disclosure may further include a fixed ring 900 coupled to the distal end of the guide tube 640. After the shaft-receiving hole 830 contacts the outer circumference of the guide tube 640 and thus the second vertically-movable assembly 800 is coupled to the agitator 6, the fixed ring 900 may be coupled to the distal end of the guide tube 640. Thus, the shaft-receiving hole 830 may be lowered into contact the top of the fixed ring 900, and the fixed ring 900 is tightly coupled to the guide tube 640. Thus, the second vertically-movable assembly 800 may be prevented from deviating from the agitator 6.

Thus, when installing the agitator 6 on the drum 4, the installation is performed in one stop manner by combining the agitator 6 and the second vertically-movable assembly 800 using the fixed ring 900. Further, when separating the agitator 6 from the drum 4, the second vertically-movable assembly 800 and the agitator 6 can be separated from one another at a time. Therefore, installation convenience may be increased. When for maintenance, the operator separates the agitator 6 from the drum 4, the second vertically-movable assembly 800 may be prevented from being detached from the guide tube 640 and being broken.

The fixed ring 900 may be implemented as an elastic rubber. The ring has a diameter that is smaller than the diameter of the guide tube 640. Thus, the ring may be configured to be tightly-fitted into the tube.

In one example, the agitator 6 must be configured to rotate independently of the drum 4 and shaft-fixed assembly 400. For this reason, the guide tube 640 extends from the bottom of the agitator 6, but needs to be spaced a certain distance from the shaft-fixed assembly 400. Further, when the fixed ring 900 is coupled to the guide tube 640, it is preferable that the fixed ring 900 is spaced apart from the shaft-fixed assembly 400 by a certain distance.

The fixed ring 900 may be coupled to the outer surface of the guide tube 640 and may be configured to wrap around the distal end or free end of the guide tube 640. Thus, even when the guide tube 640 and the shaft-fixed assembly 400 collide with each other, the ring 900 may be configured to absorb shock. In this case, the fixed ring 900 may be spaced apart from the assembly 400 to prevent contact with the shaft-fixed assembly 400 at all times.

Referring to FIG. 15B, the guide tube 640 includes first alternations of concave and concave portions 641 disposed along its outer surface. On the inner circumference face 840 defining the shaft-receiving hole 830, second alternations of concave and concave portions 841 corresponding to the first alternations of concave and concave portions may also be formed so as to be meshed with the first alternations of concave and concave portions.

The first alternations of concave and concave portions 641 may have a structure in which the hexahedron projections and grooves alternate with each other. Alternatively, the first alternations of concave and concave portions 641 may be formed in the form of teeth. Further, the second alternations of concave and concave portions 841 may be configured to be engaged with the first alternations of concave and concave portions 641.

Thus, since the second vertically-movable assembly 800 cannot receive power directly from the rotating shaft 330, the second vertically-movable assembly 800 can receive power from the driving system 300 via the agitator 6.

In other words, the second vertically-movable assembly 800 receives the power of the driving system transmitted to the agitator 6 through the guide tube 640 and then transmits the power to the shaft-fixed assembly 400. As a result, the second vertically-movable assembly 800 rotates integrally with the agitator 6 and rotate at the same number of revolutions with the agitator 6. Therefore, when the agitator is in direct contact with the drum 4, the present apparatus may rotate the drum 4 at the same speed as that of the agitator 6. Further, the second vertically-movable assembly 800 may be prevented from rotating independently from the agitator 6 and thus be prevented from a random vertical ascending or descending thereof.

In one example, third alternations of concave and concave portions 941 may be formed on the inner circumference face 940 of the fixed ring 900. The third alternations of concave and concave portions 941 may be meshed with the first alternations of concave and concave portions 641 when the fixed ring 900 is separated from the hub 410 and then is coupled to the guide tube 640. As such, the fixed ring 900 and the second vertically-movable assembly 800 may be fully integrated with the guide tube 640 and rotate integrally therewith.

In one example, referring to both FIG. 15A and FIG. 15B, the second vertically-movable assembly 800 further includes a plurality of vertical-movement ribs 850 extending radially from an inner circumferential surface defining the shaft-receiving hole 830 to an outer circumferential surface of the vertically-movable body 810. On the upper portion of the hub 410, a plurality of circumferential ribs 411 may be arranged circumferentially spaced apart from each other.

The plurality of vertical-movement ribs 850 may be configured to be seated or fitted into between the plurality of circumferential ribs 411 respectively.

Thus, the power of the driving system 300 delivered to the guide tube 640 and first alternations of concave and concave portions 841 may be transferred to the vertical-movement ribs 850 and the circumferential ribs 411 to rotate the drum 4.

In one example, the agitator 6 may further include a reference tube 620. The reference tube 620 is configured to be larger in a diameter than a diameter of the shaft-receiving hole 830 to determine the vertical-movement direction of the vertically-movable body 640. Further, the second vertically-movable assembly 800 may further include a receiving channel 820 that receives the reference tube 620. Thereby, it may be prevented that the second vertically-movable assembly 800 is vertically-moving in a tilted manner due to the water-level change in the tub 3 (See FIG. 14).

The receiving channel 820 may include a first sub-channel 823 extending downward from the bottom face defining the shaft-receiving hole 830, a second sub-channel 822 extending from the first sub-channel 823 by a length corresponding to the diameter of the reference tube 620, and a first sub-channel 823 extending upwardly along the outer surface of the reference tube 620 from the first sub-channel 823 and connected to the inner circumferential face of the vertically-movable body 810.

A bottom face of each of the first sub-channel 823 and the second ribs 822 and the third sub-channel 831 may be formed in a shape corresponding to a top face of the hub 410.

The vertical-movement ribs 850 may extend from the outer surface of the third sub-channel 831 to the inner circumference face of the vertically-movable body 810. The fixed ring 900 may be coupled to the guide tube 840 while being accommodated within the first sub-channel 823. As a result, the fixed ring 900 may be prevented from being separated away from the tube 840 due to friction with water flow or the like.

In one example, the hollow portion 411 has a hub ring 411*a* disposed on the hub 410 for receiving the rotating shaft therein and a hub protruded-plate 411*c* extending radially from the hub ring 411*a*. The circumferential ribs 430 may be spaced a certain distance from the outer circumferential surface of the hub protruded-plate 411*c*.

Figure 16A:
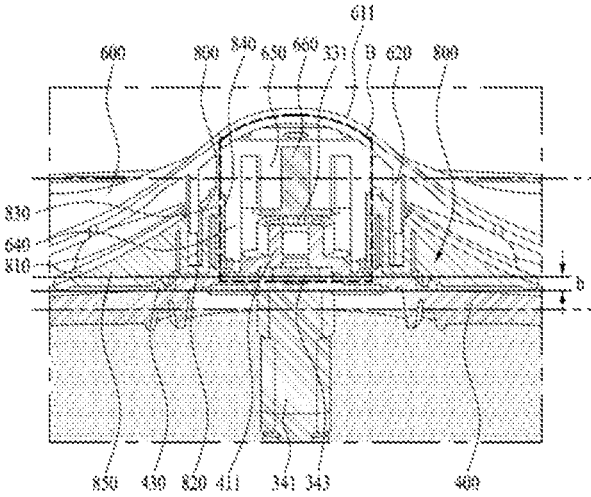
Figure 16B:
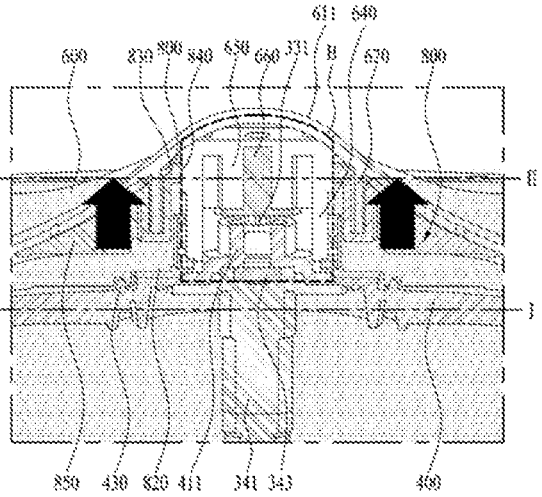

FIGS. 16A and 16B show a structure in which, in the laundry treating apparatus having the second vertically-movable assembly 800, the second vertically-movable assembly vertical-moves according to water-level, to permit or inhibit the transfer of the rotational force to the drum 4.

Referring to FIG. 16A, when the water level in the tub 3 is below a certain water level, water is drained from the bottom of the second vertically-movable assembly 80. Thus, the second vertically-movable assembly 800 descends. In this connection, the vertical-movement ribs 850 of the second vertically-movable assembly 800 are respectively sandwiched between the circumferential ribs 430. The vertical-movement channel 820 is seated on top of the hub 410.

In this connection, when the second vertically-movable assembly 800 is rotated by the guide tube 640, the second vertically-movable assembly 800 rotates the hub 410 Since the second vertically-movable assembly 800 is sandwiched between the circumferential ribs 430. As a result, this can also rotate the drum 4.

In this connection, the agitator 6 and the second vertically-movable assembly 800 rotate together. The concurrent rotation of the agitator 6 and the drum 120 may produce the same effect as that resulting from when the agitator 6 and the drum 120 rotate integrally. For example, when a spinning cycle is in progress, the drum 4 and the agitator 6 rotate at the same time and thus the twist degree of laundry may be reduced to prevent laundry damage.

Referring to FIG. 16B, when the water level in the tub 3 is above the second water-level II, water flows toward the bottom of the second vertically-movable assembly 800 and the second vertically-movable assembly 800 rises. In this connection, the second vertically-movable assembly 800 may rise until the top of the second vertically-movable assembly 800 contacts the bottom of the central portion 611 of the agitator.

The second vertically-movable assembly 800 is coupled to the guide tube 640. Thus, the second vertically-movable assembly 800 may rotate. Since the vertical-movement ribs 850 are deviated from the circumferential ribs 430, the shaft-fixed assembly 400 does not rotate. Thus, when the water level of the tub 3 is above the second water-level II, only the agitator may rotate.

For example, when the washing cycle is in progress, the drum 4 is fixed, and only the agitator 6 rotates. This may increase the cleaning efficiency by forming a stream of water inside the drum 4 and applying an impact force of appropriate strength to the laundry.

In one example, even when water level rises to the second water-level II in the tub 3, air is trapped in the second space B. thus, the water is prevented from flowing into the second space B. Thus, the second space may serve as an air gap to seal the shaft. This may prevent water from leaking to the second driving system 300.

In one example, to prevent the second vertically-movable assembly 800 from performing the upward vertical-movement to transmit the power to the drum 4, the vertical-movement ribs 850 should be separated from the circumferential ribs 430. In other words, in order to prevent the second vertically-movable assembly 800 from transmitting power to the drum 4 and to allow only the rotation of the agitator, the second vertically-movable assembly 800 should rise above the vertical level of at least the circumferential ribs 430.

Thus, a minimum vertical dimension (b) at which the second vertically-movable assembly 800 may be completely separated from the drum 4 may be defined to correspond to the vertical dimension of the circumferential ribs 430.

Figure 17A:
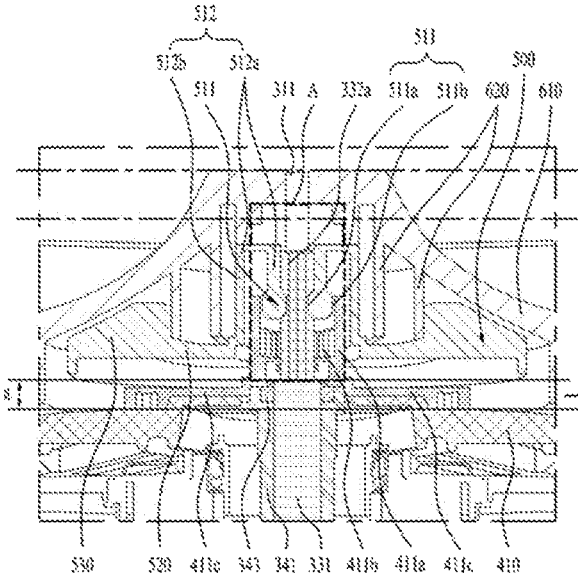
FIGS. 17A and 17B illustrate a difference between a first vertically-movable assembly and a second vertically-movable assembly.
Figure 17B:
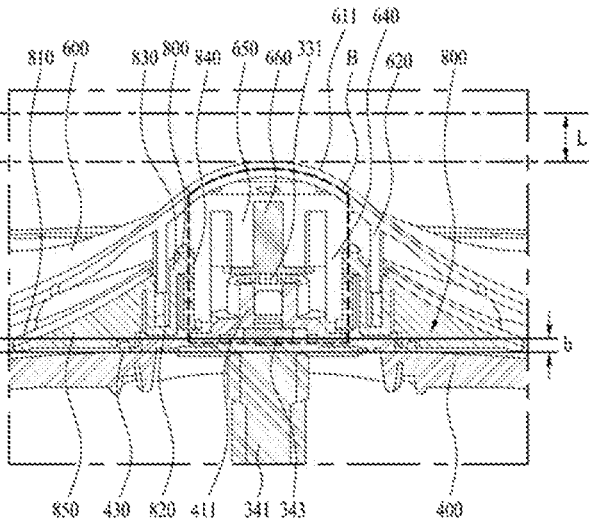

FIGS. 17A and 17B illustrate a difference between the first vertically-movable assembly 500 and the second vertically-movable assembly 800.

In the second vertically-movable assembly 800, the shaft-receiving hole 830 is defined. Thus, the assembly 800 is not in direct contact with or coupled to the rotating shaft 330. Rather, the assembly 800 is configured to perform the vertical-movement only via the agitator 6. Thus, since the space is not required in which the second vertically-movable assembly 800 is coupled to the rotating-shaft 330, a vertical dimension of the second vertically-movable assembly 800 may be decreased by a vertical dimension L compared to the first vertically-movable assembly. Thus, the central portion 611 of the agitator 6 has a smaller vertical dimension of the protrusion for receiving the vertically-movable assembly 500. Thus, the vertical dimension of the agitator 6 may also be decreased by the vertical dimension L. Thereby, the washing capacity may be further enhanced.

Further, since the first vertically-movable assembly 500 is coupled to the rotating shaft 330, the first vertically-movable assembly 500 may invade a space below the central portion 611, that is, the first space A during the upward vertical-movement of the first vertically-movable assembly 500. However, the second vertically-movable assembly 800 is completely separated from the rotating shaft. Thus, even when the assembly 800 upwardly vertically moves, the assembly 800 may not affect the air collected in the second space B at all. Thus, the air gap can be maintained at all times.

In one example, when the laundry treating apparatus according to the present disclosure may be implemented as an auxiliary laundry treating apparatus, the washing cycle may be performed even at a low water-level in the tub. In this connection, in the washing cycle, the agitator 6 and the drum 4 may need to be rotated in opposite directions, or only the agitator 6 may need to rotate.

However, as the agitator 6 rotates at a higher speed, the water-level may be lower due to temporary drainage. In this connection, even when the water-level is temporarily lowered, the second vertically-movable assembly 800 may be kept in a separate state from the drum 4 when the water level reaches a water-level as high as the vertical dimension (b) from the bottom face of the drum 4, or is higher than the water-level of the circumferential ribs 430.

Therefore, the possibility of malfunction of the vertically-movable assembly 500 may be prevented thoroughly.

As a result, the minimum vertical dimension (b) where the second vertically-movable assembly 800 may prevent the transmission of power to the drum 4 is smaller than the minimum vertical dimension (a) corresponding to the first vertically-movable assembly 500. Thus, the second vertically-movable assembly 800 may determine the rotation of the drum 4 more precisely and accurately.

The present disclosure may be embodied in various forms without departing from the scope of the invention. Therefore, when a modified embodiment includes elements of the present disclosure, the modified embodiment should be regarded as belonging to the scope of the present disclosure.

What is claimed is:

1. A laundry treating apparatus comprising:

a tub configured to receive water;

a drum rotatably disposed in the tub and configured to receive laundry;

an agitator rotatably disposed in the drum;

a stator disposed outside the tub and configured to generate a magnetic field;

a rotor disposed outside the tub and configured to rotate with respect to the stator based on the magnetic field;

a drum-rotating shaft that passes through the tub and that extends toward the rotor in a longitudinal direction, the drum-rotating shaft having a first end coupled to the drum and a second end located outside the tub;

an agitator-rotating shaft that passes through the drum-rotating shaft in the longitudinal direction, the agitator-rotating shaft having a first end coupled to the rotor and a second end coupled to the agitator;

a first serration disposed at the first end of the agitator-rotating shaft;

a second serration disposed at the second end of the drum-rotating shaft;

a fixed body that has a cylindrical shape with an open top surface and that is fixed at a position between the tub and the rotor, the fixed body defining a first through-hole that penetrates a bottom surface of the fixed body and that receives the agitator-rotating shaft;

a support body that has a cylindrical shape with an open top surface and that is rotatably disposed within the fixed body, the support body defining a second through-hole that penetrates a bottom surface of the support body and that receives the agitator-rotating shaft;

a body-driving system configured to rotate the support body within the fixed body;

a conversion portion configured to convert a rotational motion of the support body into a linear motion of the support body; and a shaft-joint rotatably disposed in the support body and configured to, based on the linear motion of the support body, reciprocate between a first point corresponding to a first vertical level of the support body and a second point corresponding to a second vertical level of the support body, wherein the shaft-joint is configured to:

based on being positioned at the first point, engage the first serration and the second serration to each other, and based on being positioned at the second point, decouple the first serration and the second serration from each other.

2. The laundry treating apparatus of claim 1, wherein the conversion portion comprises:

a first cam disposed at an inner circumferential surface of the fixed body or an inner bottom surface of the fixed body, the first cam comprising a first inclined surface that is inclined upward from a bottom surface of the fixed body toward a top face of the fixed body; and a second cam disposed at an outer circumferential surface of the support body, the second cam comprising a second inclined surface that is configured to engage with the first inclined surface and that is inclined in a direction corresponding to the first inclined surface.

3. The laundry treating apparatus of claim 2, wherein the shaft-joint comprises:

a joint body that defines a third through-hole; and a serration-engaged portion disposed in the third through-hole and configured to connect the first serration and the second serration to each other; and an annular protrusion that extends along an outer circumferential surface of the joint body and that is configured to be supported by the support body, and wherein a diameter of the second through-hole is greater than an outer diameter of the joint body and less than an outer diameter of the annular protrusion.

4. The laundry treating apparatus of claim 3, wherein the body-driving system comprises:

a motor coupled to the tub;

a rotating plate configured to be rotated by the motor;

an actuating bar having a first end connected to the rotating plate and a second end connected to the support body; and a bar-rotating shaft that is disposed between the rotating plate and the support body, that is configured to rotatably couple the actuating bar to the tub, and that defines a rotational center of the actuating bar.

5. The laundry treating apparatus of claim 4, wherein the fixed body defines a fourth through-hole that passes through a circumferential surface of the fixed body; and wherein the support body comprises a bar connector that protrudes outward from the outer circumferential surface of the support body and that is exposed to an outside of the fixed body through the fourth through-hole to connect to the actuating bar.

6. The laundry treating apparatus of claim 4, further comprising a spring configured to apply force to press the shaft-joint toward the support body, the spring having a first end coupled to the tub and a second end that contacts the shaft-joint.

7. The laundry treating apparatus of claim 6, further comprising a spring receiving groove that is configured to receive a portion of the spring and that is defined at one of a top surface of the joint body or a top surface of the annular protrusion.

8. The laundry treating apparatus of claim 1, wherein the drum-rotating shaft defines a shaft through-hole that passes through the drum-rotating shaft, wherein the drum-rotating shaft comprises a connecting gear disposed at a surface that defines the shaft through-hole, wherein the agitator-rotating shaft comprises:

a driving gear rotatably disposed within the shaft through-hole;

at least two driven gears that connects the driving gear to the connecting gear;

a gear housing rotatably disposed in the shaft through-hole, the at least two driven gears being rotatably coupled to the gear housing;

a first shaft having a first end coupled to the gear housing and a second end coupled to the agitator; and a second shaft having a first end coupled to the driving gear and a second end that passes through the first through-hole and the second through-hole to couple to the rotor.

9. The laundry treating apparatus of claim 8, wherein the tub defines a first laundry inlet at a top surface of the tub, wherein the drum defines a second laundry inlet at a top surface of the drum, the second laundry inlet being configured to communicate with the first laundry inlet, and wherein each of the drum-rotating shaft and the agitator-rotating shaft extends in the longitudinal direction that is orthogonal to the first laundry inlet.

10. The laundry treating apparatus of claim 8, further comprising:

a cabinet that defines an opening therein;

a drawer configured to insert into and withdraw from the cabinet through the opening of the cabinet, wherein the tub is disposed in the drawer;

a water supply configured to supply water from a water source to the tub; and a water discharge system configured to discharge water in the tub to an outside of the cabinet.

11. The laundry treating apparatus of claim 4, wherein the motor and the rotating plate are spaced apart from the fixed body, and wherein the actuating bar defines a hole configured to receive the bar-rotating shaft.

12. The laundry treating apparatus of claim 2, wherein the first cam is disposed at the inner circumferential surface of the fixed body, and wherein the support body is configured to move relative to the fixed body in the longitudinal direction based on the first inclined surface contacting the second inclined surface.

13. The laundry treating apparatus of claim 1, wherein the stator is disposed vertically above the rotor, and wherein the rotor surrounds at least a portion of the stator.

14. The laundry treating apparatus of claim 1, wherein the second end of the drum-rotating shaft is disposed vertically above the first end of the agitator-rotating shaft.

15. The laundry treating apparatus of claim 14, wherein the first serration is defined at an outer circumference of the first end of the agitator-rotating shaft, and wherein the second serration is defined at an outer circumference of the second end of the drum-rotating shaft.

16. The laundry treating apparatus of claim 15, wherein the shaft-joint is configured to, based on reciprocating between the first point and the second point, surround one or both of the first serration and the second serration.

17. The laundry treating apparatus of claim 15, wherein the shaft-joint has an inner circumference that defines a serration-engaged portion having a saw-tooth shape corresponding to the first serration and the second serration.

18. The laundry treating apparatus of claim 1, further comprising a bearing housing that is disposed at a bottom portion of the tub and that surrounds the drum-rotating shaft and the agitator-rotating shaft, the bearing housing defining a recess that is recessed upward and that receives the stator and the rotor.

19. The laundry treating apparatus of claim 18, wherein the bearing housing is disposed outside of the fixed body and defines a housing through-hole that allows the body-driving system to connect to the support body through the fixed body.

20. The laundry treating apparatus of claim 4, further comprising a bearing housing that is disposed at a bottom portion of the tub, that is disposed outside of the fixed body, and that defines a housing through-hole that is recessed above and that receives the second end of the actuating bar.

* * * * *